United States Patent [19]

Talarico

[11] 4,149,452

[45] Apr. 17, 1979

[54] FOLDING AND PACKAGING MACHINE

[76] Inventor: Lawrence J. Talarico, 50 Sidney Ave., Deal, N.J. 07723

[21] Appl. No.: 793,741

[22] Filed: May 4, 1977

[51] Int. Cl.[2] ..... B31B 1/46

[52] U.S. Cl. ..... 93/51 M; 53/230; 93/51 R

[58] Field of Search ..... 93/51 R, 51 M, 56 PD, 93/230; 53/383

[56] References Cited

U.S. PATENT DOCUMENTS

| | | | |
|---|---|---|---|
| 3,127,027 | 3/1964 | Roser et al. | 93/51 R X |
| 3,318,205 | 5/1967 | Lefief | 93/51 R X |
| 3,531,914 | 10/1970 | Franklin | 53/230 X |
| 3,665,675 | 5/1972 | Johnson | 53/387 X |
| 3,771,282 | 11/1973 | Flanagan | 53/230 X |

*Primary Examiner*—Roy Lake
*Assistant Examiner*—Paul A. Bell
*Attorney, Agent, or Firm*—Martha G. Pugh

[57] ABSTRACT

An automatic machine and method of operation for erecting a flat blank to form a completely folded container. The machine has a blank feed mechanism that stores flat blanks and transfers individual blanks using pressure-aided means to an infeed opening in the machine. A pressure-assisted receiver vertically movable within the machine ascends to engage the blank present at the in-feed opening and then draws the blank, including any articles to be packaged loaded during a pause at the infeed opening, downwardly into the machine past a series of folding members to partially erect the blank into a tray-like container. The container is now advanced in a horizontal direction along guide means and past another arrangement of folding members to further fold the blank to form a semi-erected container. An elevator positioned to receive the processed blank from the guide means raises the semi-erected container into a compression chamber to complete final folding operations. Discharge means eject the completed container through an output opening in the machine.

To form a sealed container, pressure-supplied glue applicators are positioned at an acute angle adjacent the guide means so as to apply glue to all blank surfaces requiring glue during the horizontal traversal of the partially-erected container along the guide means. During a first activity, pressure is supplied to the applicators so that glue at a first volume per unit length is applied to the side flaps. During a second activity, the pressure is increased so that the volume of glue per unit length applied to the front panel is substantially the same as the first volume.

23 Claims, 18 Drawing Figures

FOLDING AND PACKAGING MACHINE

BACKGROUND OF THE INVENTION

1. Field of the Invention

This invention relates, generally, to automatic packaging machines and, more particularly, to the types that sequentially fold a paperboard blank about a quantity of articles and subsequently glue the erected blank to form a sealed container that encloses the articles.

2. Description of the Prior Art

U.S. Pat. No. 3,531,914 issued to M. G. Franklin on Oct. 6, 1970 and U.S. Pat. No. 3,665,675 issued to R. H. Johnson on May 30, 1972 are both representative of prior art packaging machines that commence operation with a flat, one-piece paperboard blank. To elucidate some shortcomings of these prior art packaging machines, an overview description of both structure and operation of the conventional machines is now provided.

A typical cycle of operation of a prior art packaging machine begins with the machine operator manually positioning the flat paperboard blank over a machine input opening which is aligned with a vertically movable in-feed mechanism. The articles to be encased are then manually loaded on the section of the blank which ultimately forms the bottom of the sealed container. The automatic portion of the cycle is now activated and downward movement of the vertically movable mechanism draws both the blank and the articles into the machine. If the total weight of the articles does not suffice to hold the blank in-place during drawdown, additional holding force is provided by vacuum acting through suction devices formed as part of the movable mechanism. During descent, the blank engages a plurality of folding members and when the mechanism reaches its lowest position, front and back panels as well as two side flaps, all part of the blank, are perpendicular to the bottom panel of the blank and entrap minor flaps of the blank, thereby forming a tray containing the articles. The semi-erected container with articles is now removed from the vertical mechanism and moved along the first leg of a horizontal, generally L-shaped path, during which movement glue is applied to the outer surfaces of the two side flaps. The glue is applied to one side flap from a glue application station comprising at least one glue positioned along the path of lateral movement of the side flap. Also, a similarly designed and arranged glue station simultaneously applies glue to the other side flap. As movement along this leg continues, a cover panel, interconnected with the blank, is folded into a horizontal position and two top flaps, both associated with the cover panel, are folded downwardly to contact the glue on the side flaps. The partially folded container is now reoriented by directing the blank along the second leg of the L-shaped path, whereupon glue from a separate applicator station, distinct from the previous glue applicator stations, is applied to the outer surface of the front panel. Continued movement of the container along the second leg causes the sealing flap, secured to the cover panel, to be folded downwardly to contact the adhesive on the front panel. Also, during traverse of the second leg, the previously glued sides of the container engage abutments that firmly hold the sides in-place so the glue may properly set. The completely sealed container is now either directly ejected from the machine through a discharge port if the glue is fully set, or is transferred to a compression chamber for glue curing. In the latter case, after a prescribed time interval, the container is then ejected from the chamber through the discharge port.

In the aforementioned overview description, one evident shortcoming of a typical prior art packaging machine is the inordinate number of manual tasks that must be completed by the machine operator before activation of the automatic phase of the operation. Besides placing the articles on the blank, the operator has the additional responsibility of correctly positioning the blank at the in-feed port. Thus, because of the exertions effected by one-at-a-time feeding of the blanks, the accuracy of the blank placement and, indeed, the speed of the overall packaging operation, is dependent upon the manual dexterity and stamina of the machine attendant. A fast, accurate blank feed step would benefit both packaging quality and production efficiency.

Other shortcomings of a conventional machine can be explained by focusing on the L-shaped path design. In this L-shaped arrangement, two distinct orientations involving two separate movements of the blank are employed to apply glue to the three surfaces requiring adhesive, namely, the two side flaps and the front panel. Therefore, this design necessitates a minimum of three glue application stations, including two oppositely directed stations arranged on the first leg of the path to spread glue separately but synchronously on each side flap, and a third station on the second leg that applies glue to the front panel. Also, this design usually means that each leg of the path has similar or even duplicate members, such as rails to guide the blank and mechanisms to move the blank along the rails. The shortcomings that arise with the prior art packaging machines of the type described may be observed by comparison of the L-shaped design with the inventive subject matter of this instant application. It is to be demonstrated hereinafter that a sealed container can be formed in a machine using only one glue-applying movement of the blank and wherein no blank reorientations are necessary and glue is applied to all three of the surfaces requiring glue from only two glue applicator stations. Hence, in view of the subject matter of this application, additional shortcomings of the prior art designs include reduced reliability, increased maintenance, higher cost and large floor space requirements, all of which are primarily due to duplication of both structure and operations.

SUMMARY OF THE INVENTION

Accordingly, it is an object of this invention to provide an efficient, reliable and versatile automatic packaging machine and method of operation that minimize manual interactions and offer structural improvement and production benefits to encourage and induce widespread use.

Another object of this invention is to provide an automatic packaging machine and method of operation which utilize a pressure-aided automatic blank feed mechanism to yield accurate, effortless and speedy blank access and placement.

It is a further object of this invention to provide an automatic packaging machine and method of operation requiring only one basic movement of the blank to accomplish all required glue application operations without reorientation of the blank during this movement.

Yet another object of this invention is to provide an automatic packaging machine of substantially reduced size yet is easily adjustable so as to accommodate various container sizes to increase machine versatility and cost effectiveness.

These and other objects are realized in accordance with the present invention of an improved packaging machine and method of operation which subject the blank to fewer distinct movements and orientations to effect gluing and which minimize manual interactions. The device in accordance with the present invention generally comprises the following five interrelated and mutually dependent means traversed seriatim: (a) a pressure-aided blank feed mechanism that stores numerous blanks and, automatically during each machine cycle, removes a single blank from storage and accurately positions the blank over the machine in-feed opening; (b) a pressure-assisted vertical erection mechanism that, firstly, operates in conjunction with the blank feed mechanism to receive and then retain the blank appearing at the in-feed opening and, secondly, draws the blank, along with the previously manually or automatically loaded articles to be packaged, downwardly into the machine in order to partially erect the container about the articles; (c) a glue application mechanism, including symmetrically located, angularly positioned, pressure-supplied glue applicators, that receives and then laterally moves the semi-erected container past the applicators and initiates final folding operations. During the lateral movement, a first gluing activity causes adhesive to be applied to the side flaps by the glue applicators supplied with a first pressure and, as lateral movement continues, a second gluing activity causes adhesive to be applied to the front panel by the glue applicators, supplied with a second pressure at least as great as the first pressure; (d) a compression mechanism that receives and then houses the nearly completed container to await curing of the glue; and (e) a discharge mechanism for subsequent and suitable ejection of the sealed container from the machine. More specific descriptions of the five interdependent means of the preferred embodiment are now provided.

In the preferred embodiment, it is helpful to visualize the machine divided into two separately identifiable ensembles, namely: (i) a rectangularly-shaped base housing and (ii) the blank feed mechanism. The base housing contains the erection mechanism, glue application mechanism, compression mechanism and discharge mechanism. Furthermore, the erection, glue application and compression mechanisms cause movements of the blank to take place in a single plane along a vertically oriented U-shaped path. The base housing has an in-feed opening on its top, near the front, and an output opening on its back wall. The blank feed mechanism is mounted on the top of the base housing, near the back, and has members constructed and arranged to cooperate with the mechanisms interior to the base housing.

In the preferred embodiment, the blank feed mechanism includes a storage magazine, a platen and a pivot arm mechanism. A quantity of blanks is stacked up-right in the magazine, which is inclined to produce gravity-assisted advancement of the stack as individual blanks are removed for use. Alternatively, a spring loaded mechanism may augment the advancement of the stack. Once each packaging cycle, the platen, which is provided with vacuum devices, accurately accesses the front blank of the stack, grasps this blank with the vacuum devices, removes the blank in a manner to mitigate interblank suction, and delivers this blank to the in-feed opening in the base housing. The platen is mounted on the pivot arm mechanism, which translates mechanically generated up-and-down motion to rotational movement of the platen. The arc of rotation of the platen relative to the arm mechanism is precisely controlled by an interposed sprocket mechanism. As the platen transports the blank to the in-feed opening, a component of the vertical erection mechanism called a former ascends to the top of the opening to receive the blank. The former is provided with vacuum receptors. When the blank is properly positioned over the opening, the vacuum supplied to the platen is released, and then a pulse of air is delivered to the platen causing a snappy release of the blank. Concurrent with this air pulse, vacuum builds-up on the receptors. which then graps the underside of the blank. Therefore, because of the synchronized operation of both the blank feed mechanism and the vertical erection mechanism, accurately registered blanks in the magazine are transported and precisely positioned on the former.

In one mode operation, the former remains at its elevated position for a prescribed time interval so that the articles to be packaged may be loaded, either manually or automatically, onto that part of the blank that eventually forms the bottom of the container. Thereafter, under control of the vertical erection mechanism, the blank and articles are drawn downwardly into the machine past a series of folding fingers and plows located on side walls of an erection chamber. The fingers are positioned to cause the minor flaps to fold so that they are entrapped by front and back panels as well as two side flaps folded by the plows. The downward motion forms the blank into a tray containing the articles and orients the top portion of the blank in a vertical sense.

In another mode of operation, the former draws the blak partially into the erection chamber before pausing for the prescribed interval. During partial drawdown, the folding fingers and plows erect the blank in tray-like fashion so that during the pause, loose articles may be loaded into the semierected container. Thereafter the vertical erection mechanism draws the tray with articles to the lower position as described in the foregoing paragraph.

In either mode of operation, at the bottom of the lowering stroke, vacuum to the receptors is released, and then a puff of air is delivered to the former causing a speedy release of the blank. Simultaneous with the puff of air, vacuum is redirected to the blank feed vacuum devices, which are ready to grasp the next blank in the stack to be processed.

In the base housing, the container is now transferred to the glue application mechanism wherein it is pushed horizontally along guide means having peripherally-located folders and plows, which force the top of the blank downwardly and binds two top flaps so that they entrap the minor flaps. As the semierected container proceeds along the guide means, two strategically placed, fixed glue guns supply adhesive to the outer surfaces of the side flaps as well as the front panel. This is accomplished by arranging one glue gun on each side of the horizontal path and aiming each gun at an acute angle relative to the direction of motion of the container. Initially, both guns are provided with sufficient pressure to simultaneously apply a stream of adhesive to each side flap as it moves uniformly past the glue gun. Then, as the corners of the container approach, both guns are momentarily deactivated and, during deactivation, the pressure supplied to the guns is increased. Once the corners pass the immobilized guns, they are again activated to allow each gun to project a stream of adhesive across one-half of the front panel. Thus, with this glue application arrangement, each gun applies approximately the same volume of glue per unit length on the full side flap adjacent to it and half of the front panel.

At the end of the glue application stage, lateral movement ceases, and the nearly completed container is transferred to the compression mechanism to await curing. The transfer is accomplished via an elevator that lifts the continer into a compression chamber vertically aligned with the elevator. Upward movement of the container allows fixed forming plows, located at the entrance to the compression chamber, to fold a sealing flap and two top flaps into contact with the glue on the body of the container. compression force is generated by adjustable chamber walls. Latches are interposed in the chamber so that as the elevator descends, the container is retained in the compression chamber.

Containers constructed during subsequent machine cycles enter the compression chamber under the last container placed in compression. As the elevator raises a newly formed container, the top container in the queue enters the discharge mechanism, wherein this top container is transferred to an inclined gravity-operated conveyor and trundled to the discharge port in the back wall. Depending on the size of the container, one or more containers may be held in compression.

A particular feature of the automatic packaging machine constructed in accordance with the present invention results from the angular orientation of the two symmetrical arranged glue applicator stations that apply adhesive to the three surfaces during one lateral displacement of the blank. During the first stage of gluing, adhesive from one gun projects onto the side flap, which remains equidistant from the glue source while the flap passes the source. Of particular significance, however, is that during glue application to the front panel, the distance between the front panel surface and the glue source increases while lateral movement continues. Increased pressure supplied to the guns during front panel gluing insures that the amount of glue per unit length applied to the front panel is approximately the same as the amount of glue per unit length applied to the side flaps. This is in contrast to prior art packaging machines that rely solely upon an equal surface-to-source distance and a fixed pressure supplied to the guns. This reliance dictates the necessity of two glue application movements and orientations of the blank.

These and other objects, features and advantages will be apparent hereinafter from a detailed disclosure of the invention relative to the attached drawings.

BRIEF DESCRIPTIONS OF THE DRAWINGS

Figure 1:
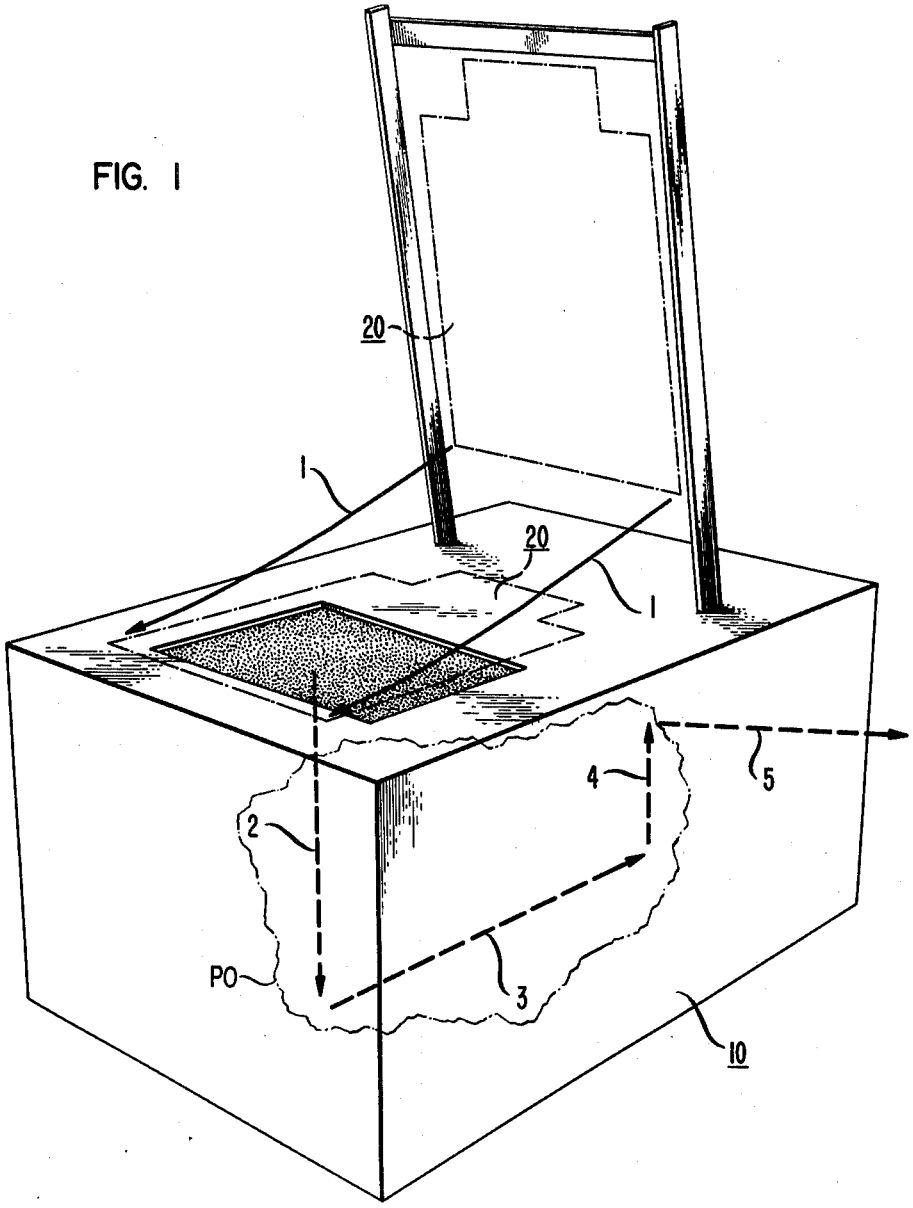
FIG. 1 is a frontal perspective view of the automatic packaging machine constructed in accordance with the present invention showing a one-piece paperboard blank in phantom and the path of movement of the blank shown diagrammatically.
Figure 3:
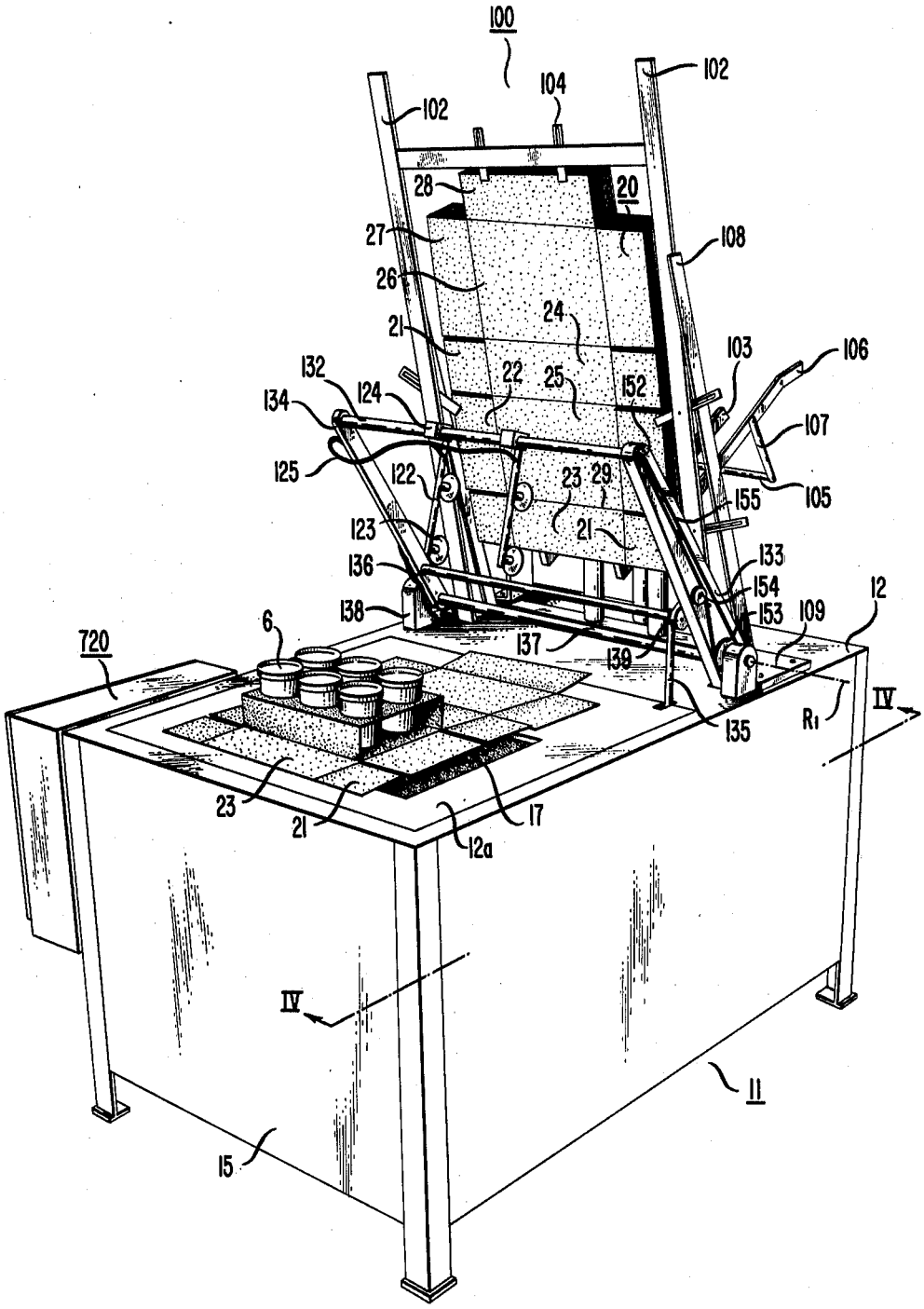
FIG. 3 is a frontal perspective view of the automatic packaging machine of FIG. 1 showing the preferred embodiment of the pressure-aided blank feed mechanism mounted on the base housing of the machine.
Figure 4A:
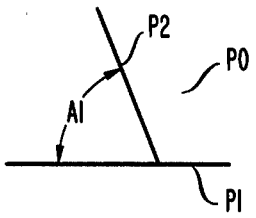
Figure 4B:
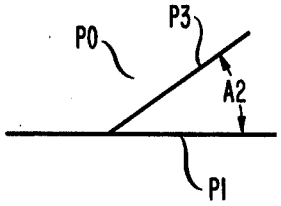
Figure 4C:
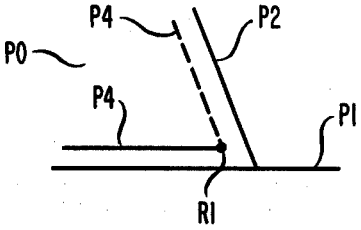
Figure 3A:
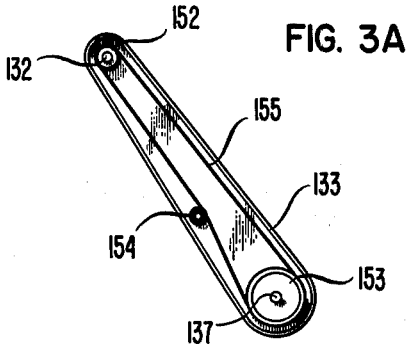
Figure 13:
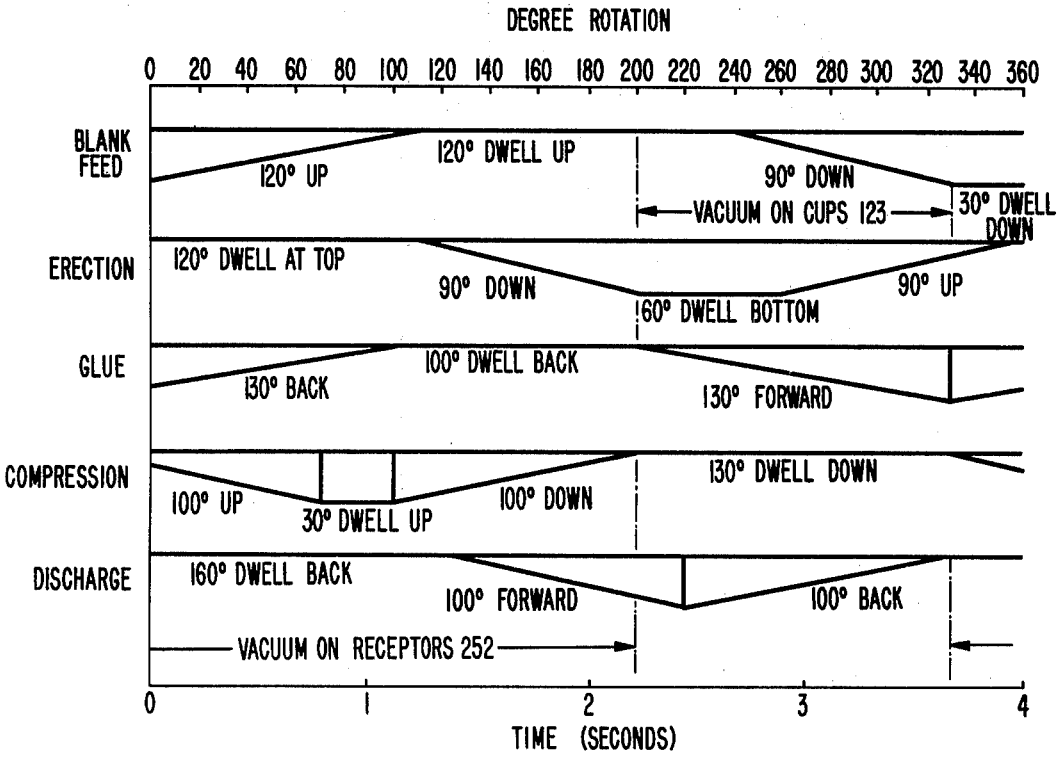
Figure 5:
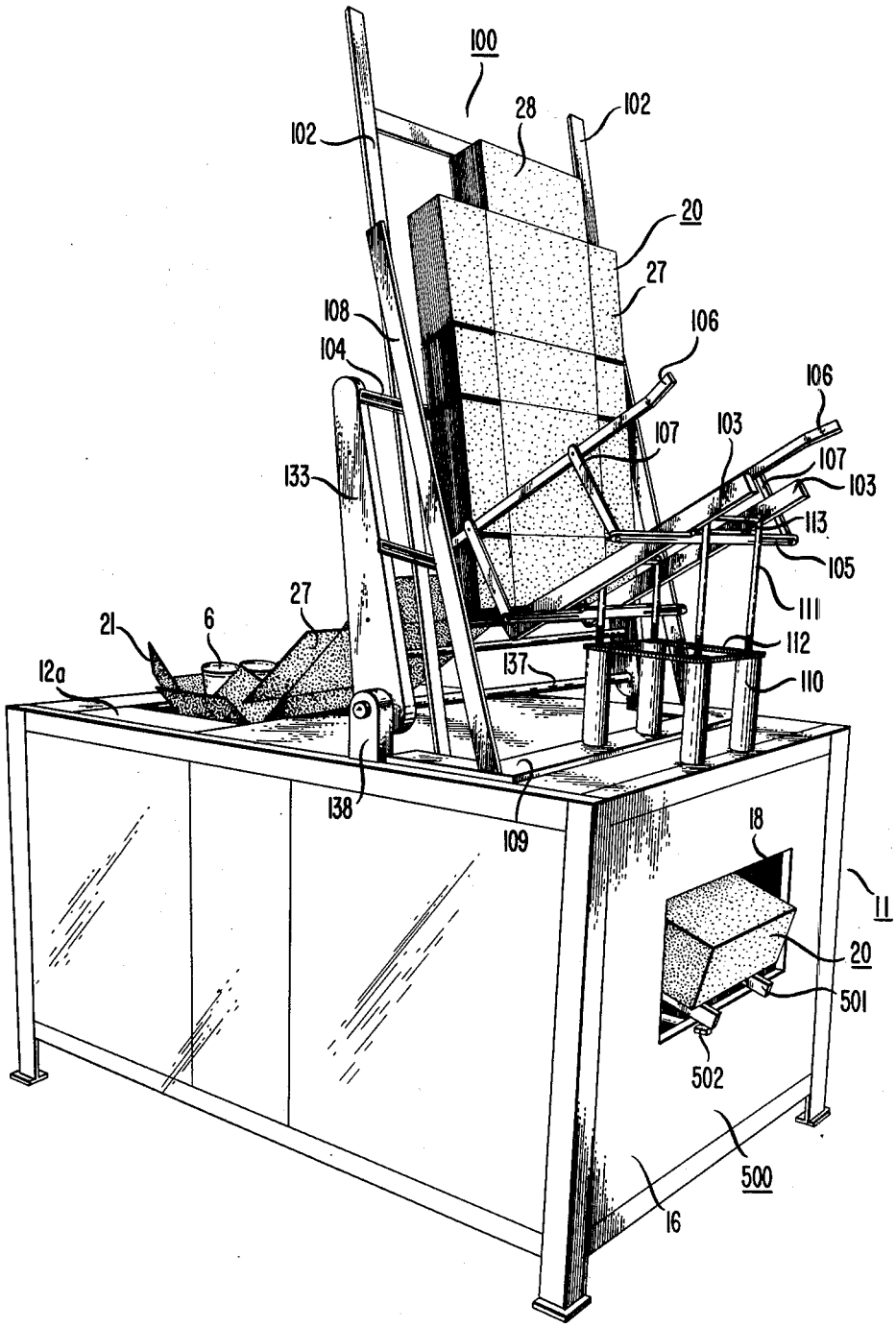
Figure 6:
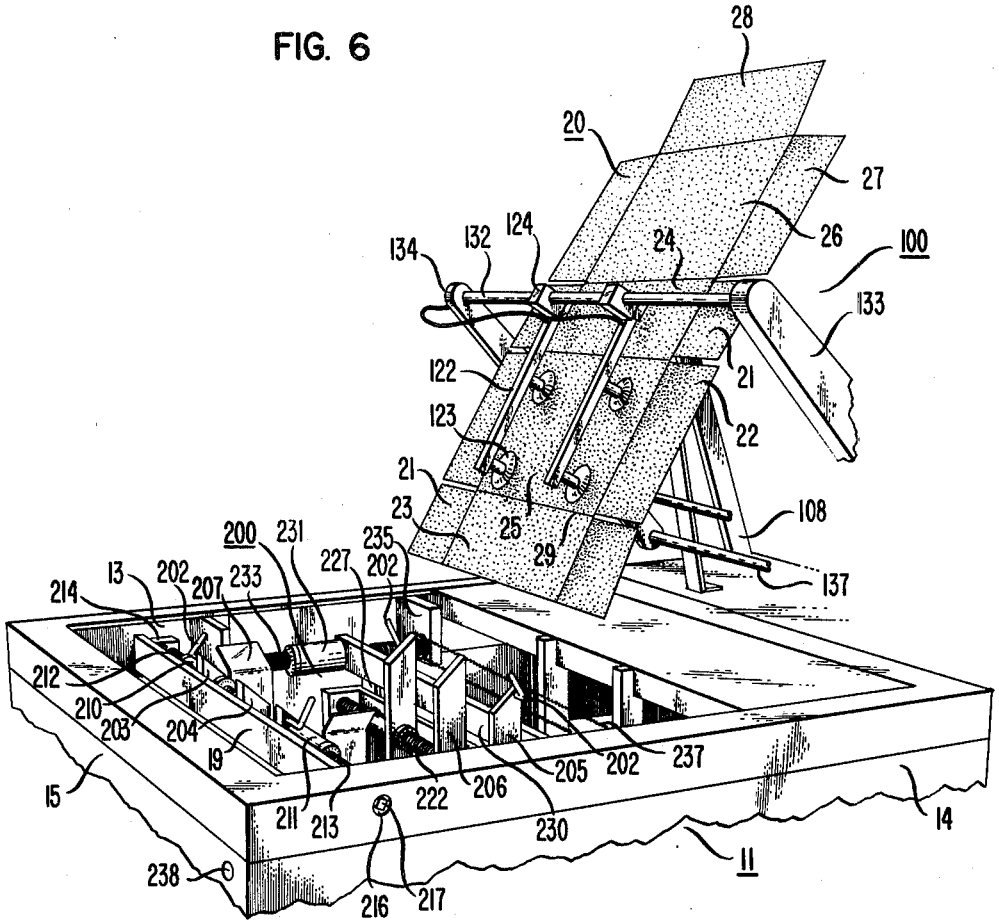
Figure 7:
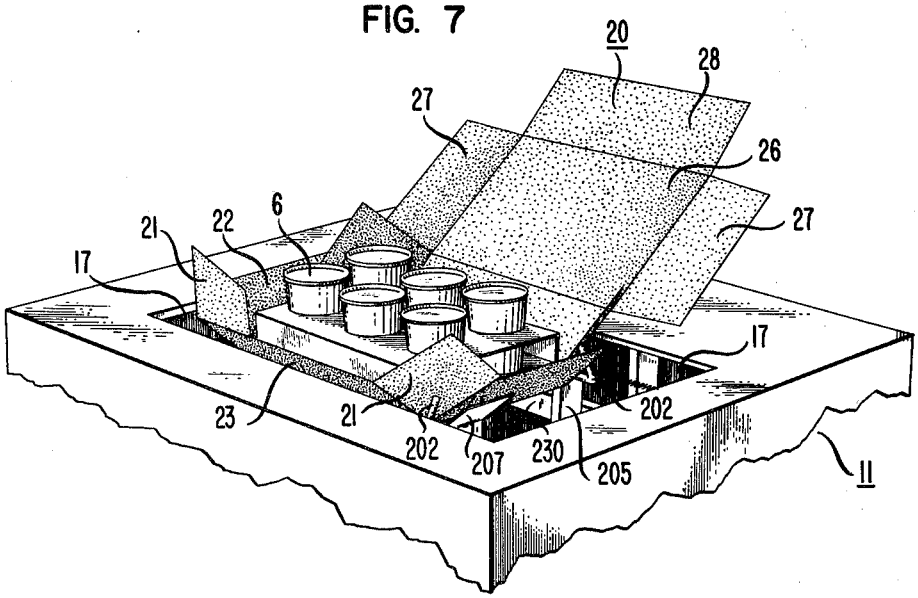
Figure 8:
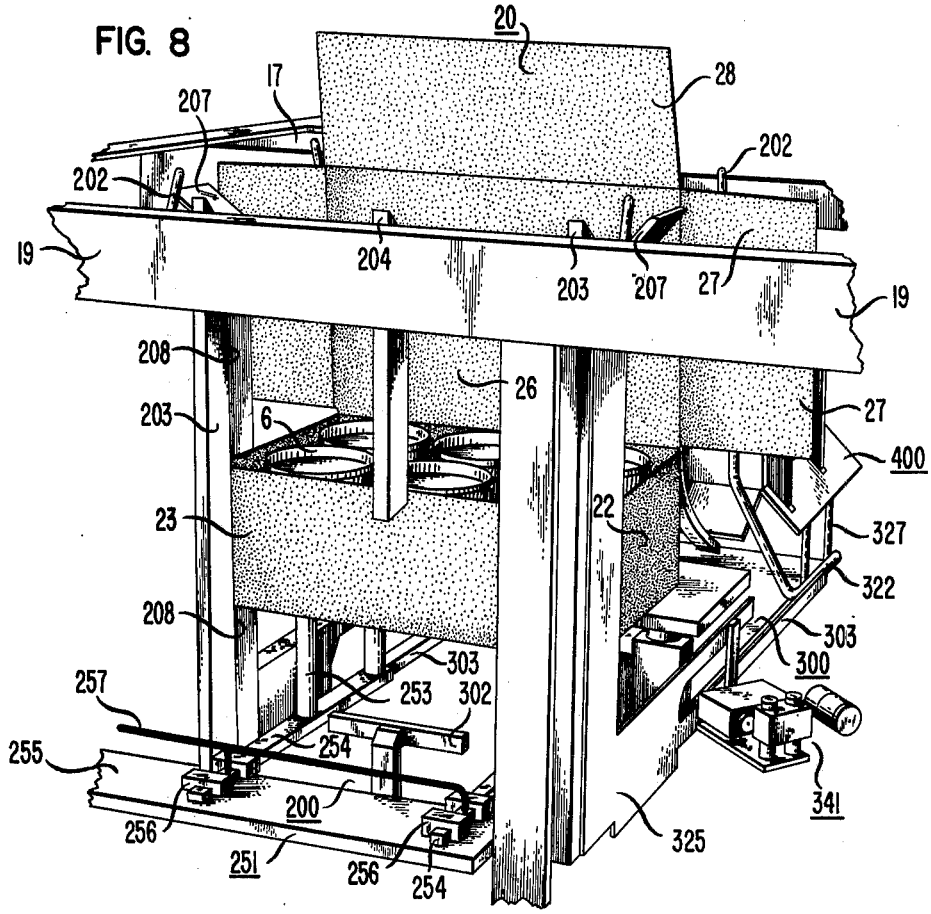
Figure 9:
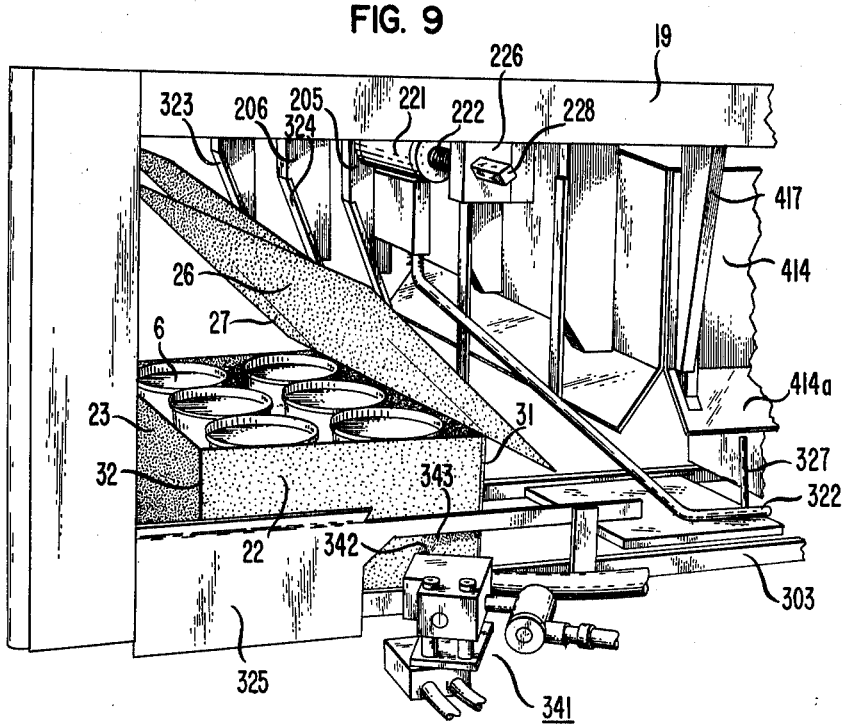
Figure 10:
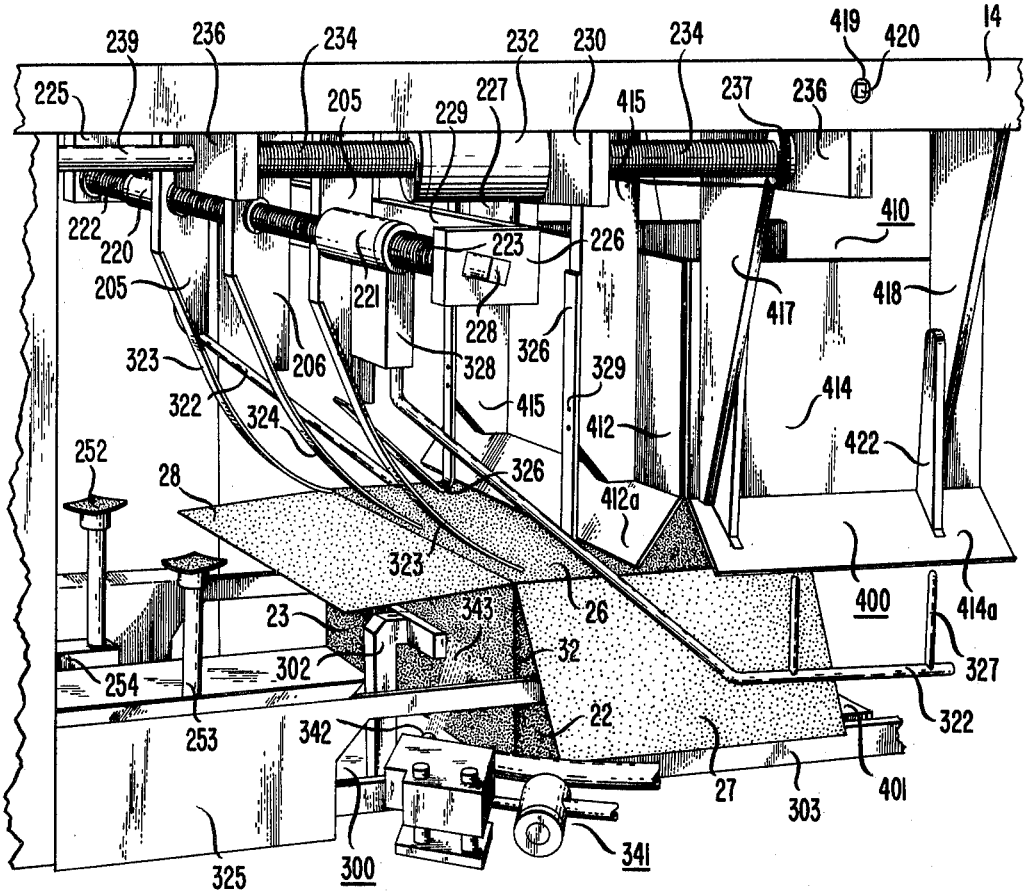
Figure 11:
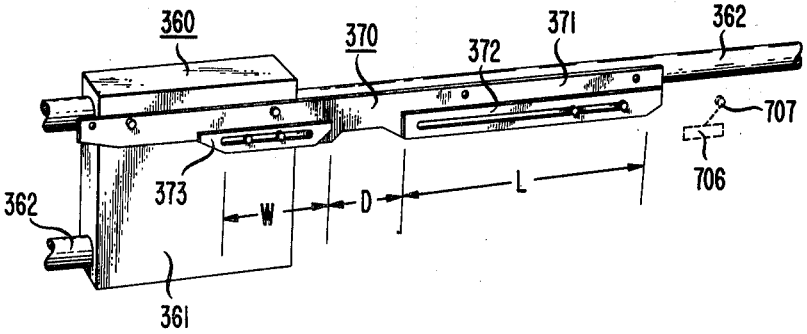
Figure 12:
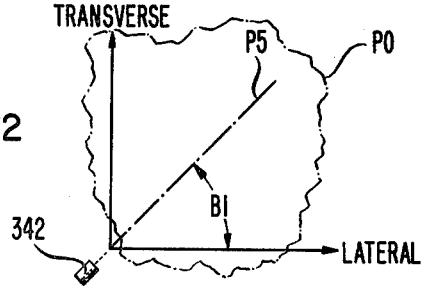
Figure 14:
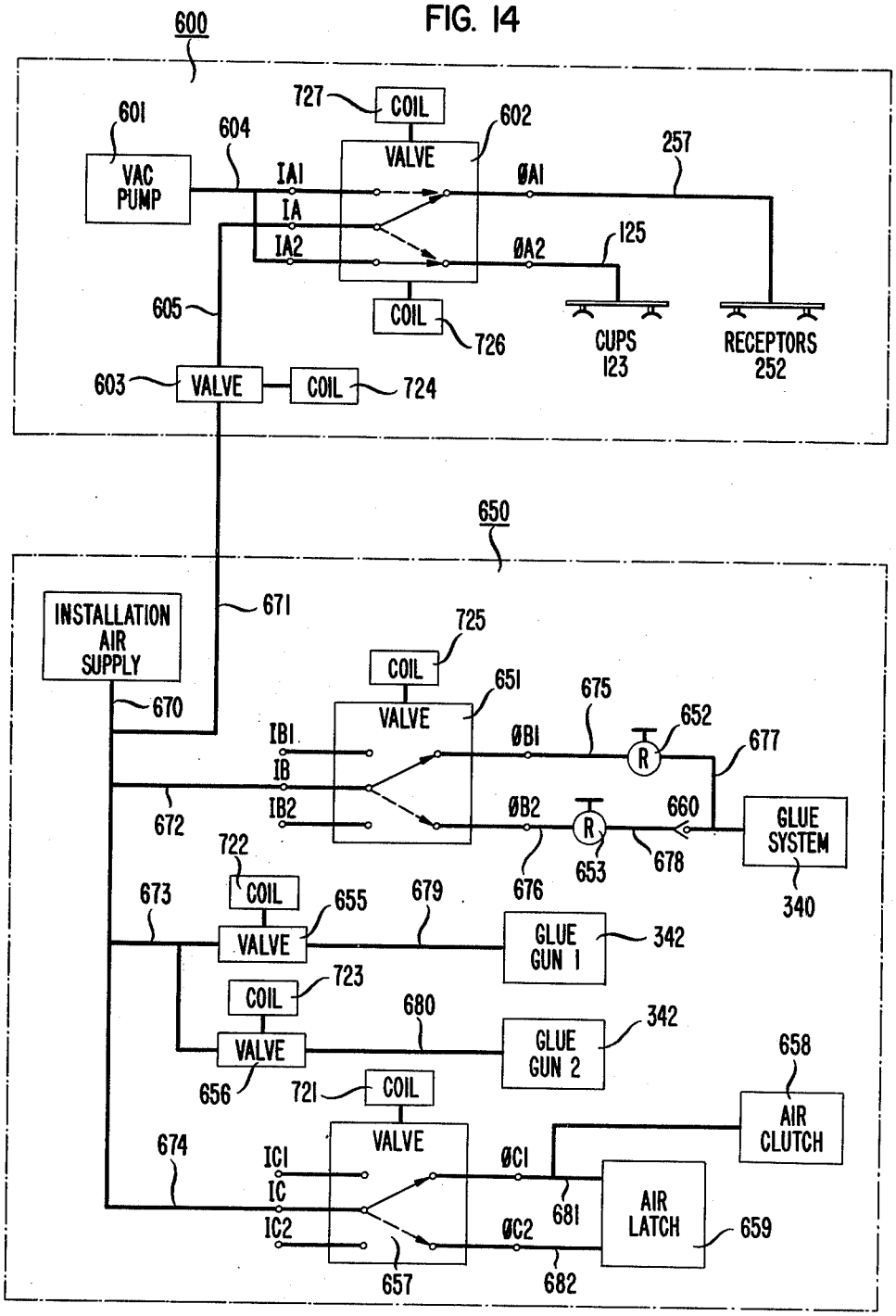
Figure 15:
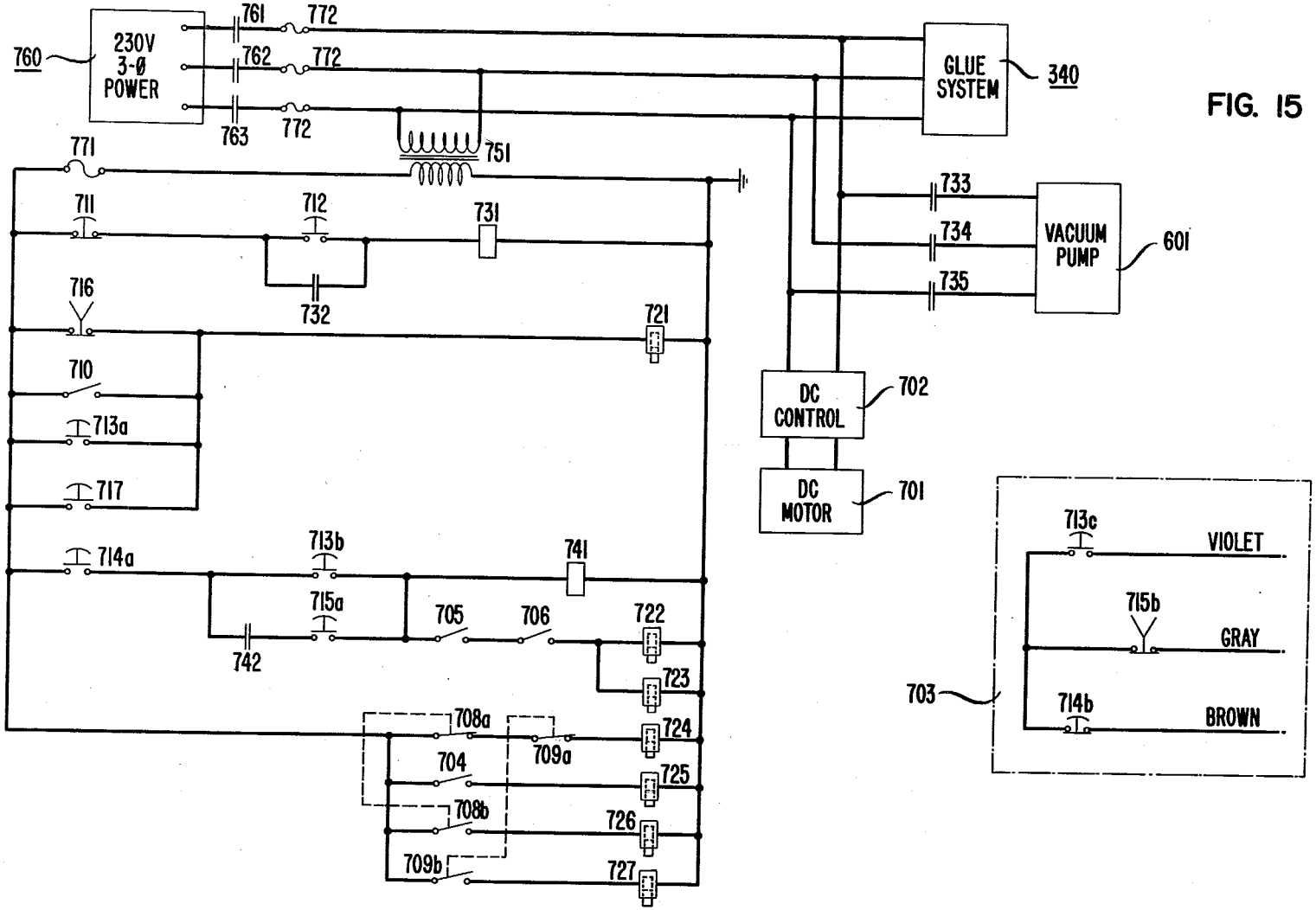

FIG. 3*a* is an isolated side view of the sprocket mechanism interposed in the pressure-aided blank feed mechanism of FIG. 3;

FIG. 4*a* is a geometrical representation showing the angular relationship between the plane containing the blank storage magazine and the plane of the top of the machine, as viewed in the direction of lines IV—IV in FIG. 3;

FIG. 4*b* is a geometrical representation showing the angular relationship between the plane containing the blank storage runners and the plane of the top of the machine, as viewed in the direction of lines IV—IV in FIG. 3;

FIG. 4*c* is a geometrical representation showing the angular relationship between the extreme locations of the plane containing the blank arms and the plane of the top of the machine, as viewed in the direction of lines IV—IV in FIG. 3;

FIG. 5 is a perspective view of the automatic packaging machine shifted counterclockwise 90 degrees relative to the view of FIG. 3 and shows the preferred embodiment of the pressure-aided blank feed mechanism mounted on the base housing of the machine;

FIG. 6 is a frontal perspective in fragment of the machine of FIG. 1 showing the preferred embodiment of the top section of the pressure-assisted vertical erection mechanism as well as a portion of the preferred embodiment of the pressure-aided blank feed mechanism delivering a blank to the in-feed opening;

FIG. 7 is a frontal perspective view in fragment of the automatic packaging machine of FIG. 1 showing a partially erected blank in the top section of the preferred embodiment of the pressure-assisted vertical erection mechanism;

FIG. 8 is a frontal perspective in fragment of the machine of FIG. 1 showing the preferred embodiment of the bottom section of the pressure-assisted vertical erection mechanism as well as the forward portion of the preferred embodiment of the glue application mechanism;

FIG. 9 is a fragmentary isometric view of the machine of FIG. 1 showing the central section of the preferred embodiment of the glue application mechanism including a glue station;

FIG. 10 is a fragmentary isometric view of the machine of FIG. 1 showing the rearward section of the preferred embodiment of the glue application mechanism as well as the main portion of the preferred embodiment of the compression mechanism;

FIG. 11 is a perspective view of a portion of the preferred embodiment of the glue application mechanism showing the notched plate mechanism that controls activation and deactivation of the glue guns;

FIG. 12 is a geometric representation showing the angular relationship between the plane of projection of the adhesive relative to the direction of motion of the container;

FIG. 13 is a mechanical timing diagram depicting the relative displacements of the positive displacement camshaft systems;

FIG. 14 is a schematic diagram of the vacuum and air circuits of the preferred embodiment of the automatic packaging machine;

FIG. 15 is a schematic diagram of the electrical circuitry of the preferred embodiment of the automatic packaging machine.

DETAILED DESCRIPTION

Referring now to FIG. 1, machine 10 automatically processes a flat, one-piece paperboard blank 20, shown in phantom on the machine, sequentially along a path which subjects the blank to various feeding, folding and gluing operations in a predetermined pattern. The path of movement of the blank during a machine cycle includes five principal path segments effected serially to form a sealed container. The first path segment of movement is the combined rotational and translational movement denoted by path segment 1; the second is the downward translational movement shown as path segment 2; the third is lateral translational movement along path segment 3; the fourth is upward translational movement shown as path 4; and the fifth is the laterally inclined translational movement along path segment 5. Path segments 2, 3 and 4 cause movement of the blank to take place in a single plane, designated p0, along a vertically oriented U-shaped path in machine 10. Plane p0 establishes a reference orientation to which all other orientations may be referred. Each of these path segments and the associated mechanisms will be described in detail hereinafter. The detailed description is divided into three main categories. First, attention is focused on mechanical aspects of the structure. Then, the air and vacuum circuits are explained and, finally, electrical circuitry is presented. However, since the categories interact, some overlap in the exposition is needed for clarity.

Figure 2:
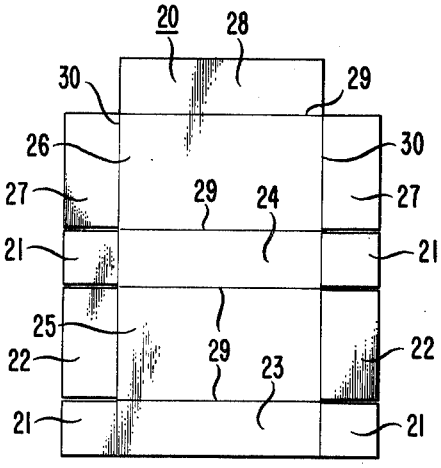
FIG. 2 is a plan view of a flat, scored, one-piece paperboard blank for use with the preferred embodiment of the automatic packaging machine.

To assist in the description, a typical paperboard blank suitable for for use with machines 10 of FIG. 1 is now defined. With reference to FIG. 2, a paperboard blank 20 is shown, which when completely erected, encompasses the articles to be packaged via certain flaps and panels that define portions of the blank. The blank 20 is formed from a rectangular sheet of corrugated paperboard or chipboard which is cut and scored to provide the panel members and flap members. The same characters of indicia will be used for the members of a flat blank as well as for the members of the container as it is being processed. The surfaces of the blank members that form the interior of the final container are referred to as inner surfaces, whereas those surfaces forming the exterior of the container are designated outer surfaces. As depicted in FIG. 2, bottom panel 25 and cover panel 26 are interconnected by back panel 24. A front panel 23 extends from the bottom panel 25 opposite back panel 24. A sealing flap 28 extends from the cover panel 26 opposite back panel 24. The junctions between the panels and flap are scored, as denoted by lines 29 disposed transversely on the blank. A pair of vertical score lines 30 lie equidistant from the center of the sheet to define minor flaps 21 extending from the vertical edges of back panel 24 and the vertical edges of front panel 23. Score lines 30 also determine side flaps 22 which extend from the vertical edges of bottom panel 25 as well as top flaps 27 which extend from the vertical edges of cover panel 26. The vertical dimension of back panel 24 determines the height of the finished container. Also, the distance between score lines 30 determine the width and the vertical dimension of bottom panel 25 determines the length of the completely folded container.

1. Mechanical Description

Translational and rotational movement along path segment 1 of FIG. 1 is provided by the pressure-aided blank feed mechanism 100 shown in FIGS. 3 and 5; mechanism 100 has indicia in the range 100 to 199. Referring to FIG. 3, a quantity of flat blanks 20 stands up-right in rectangular storage magazine 102 with the inner surfaces of each blank 20 facing front machine wall 15. Furthermore, the edge of each front panel 23 is in slidable relation to runners 103, and typically either minor flaps 21 or side flaps 22, depending of the height of the finished container, in slidable relation with guides 106. Also, guides 106 are adjustable via blank supports 107 slidably mounted to runner supports 105 to accommodate containers of different width.

Magazine 102 lies a plane perpendicular to the reference plane P0 (see FIG. 1) and FIG. 4*a* shows a geometrical representation of the view of the plane containing magazine 102, designated plane P2, relative to plane P0 as well as the plane containing the top 12, designated plane P1, as viewed in the direction of lines IV—IV in FIG. 3. Angle A1 is the acute angle between planes P1 and P2 and is fixed preferably at 80 degrees. As shown in FIG. 3, magazine 102 is mounted at this angle to top 12 with side supports 108 and base support 109. Runners 103 (see FIG. 5) also are taken to lie in a plane perpendicular to plane P0 (see FIG. 1) and FIG. 4*b* shows a geometrical representation of the view of the plane containing runners 103, designated P3, relative to plane P0 as well as plane P1 as viewed along direction lines IV—IV in FIG. 3. Angle A2 is the acute angle between planes P1 and P3; A2 is typically between 20 and 30 degrees depending upon the weight of the blanks initially loaded into magazine 102, and A2 is adjusted to produce automatic, gravity-assisted advancement of the stack as individual blanks are removed for use.

With reference to FIG. 3, once each packaging cycle, four symmetrically positioned suction cups 123: grasp the front blank in the stack on the inner surface of bottom panel 25; remove this blank by flexing adjustable retaining fingers 104 and creating a peeling away motion to mitigate interblank suction; and deliver this blank to the in-feed opening 17 in base 11. The peeling motion is defined as one wherein the rate of departure of front panel 23 from magazine 102 is greater than the rate of departure of the sealing flap 28 from magazine 102. Cups 123 are designed to transport and precisely position blank 20 over opening 17. Consequently, the score line 29 between front panel 23 and bottom panel 25 must be correctly aligned relative to cups 123 to insure proper registration at opening 17. This alignment is accomplished by adjusting the vertical height of runners 103. With reference to FIG. 5, which is a view shifted counterclockwise 90 degrees with respect to FIG. 3, the height of runners 103 is easily altered using the arrangement having spindles 110 mounted to base 11, vertical threaded legs 111 inserted in spindles 110, gear and chain drive 112 rotatably mounted on spindles 110 and linking legs 111, and horizontal support rods 113. The ends of each support rod 113 are fixedly joined to each runner 103 and the upward end of each leg 111 is fixedly attached adjacent each end of support rod 113. Rotation of gear and chain drive 112 raises or lowers legs 111 in spindles 110 depending on sense of rotation.

Referring again to FIG. 3, suction cups 123 are mounted on a manifold 122, which provides mechanical support as well as serving to connect vacuum and air circuits via hose 125 to the cups 123. The manifold 122 is fastened to a rotating shaft 132 using clamps 124. One end of the shaft 132 is pivotally supported by a hollow drive arm 133, whereas the other end of the shaft 132 is rotatably supported by follower arm 134. Arms 133 and 134, which define a plane perpendicular to plane P0 (see FIG. 1), both fasten to and turn with shaft 137, also in the plane of arms 133 and 134, under control of cam drive linkage 135. Shaft 137 is pivotally supported by shaft mounts 138 anchored to top 12. The center line of shaft 137 defines an axis of rotation R1 (shown dashed).

FIG. 3*a* is an isolated side view of hollow arm 133 showing the locations of rotating sprocket 152 and fixed sprocket 153 as well as take-up sprocket 154 linked by a single drive chain 155 all housed in hollow arm 133. With reference again to FIG. 3, sprocket 152 is pivotally mounted to one end of interposed rotating shaft 132. Sprocket 153 is concentric with shaft 137 and is fixedly attached to adjacent mount 138. A conventional positive displacement camshaft system, designated the blank feed cam system and which need not shown insofar as this invention is concerned, provides essentially up-and-down motion to cam linkage 135. This motion is coupled via drive flange 139 and support shaft 136 to arms 133 and 134, which transform this motion to rotational motion about about axis of rotation R1. FIG. 4*c* is a geometrical representation of axis of rotation R1 and the plane containing arms 133, 134 and shaft 137, designated plane P4, relative to planes P0, P1 and P2 as viewed along lines IV—IV in FIG. 3. Plane P4 moves about axis R1 from a position parallel to plane P1 (solid line P4) at one extreme to a position parallel to plane P2 (dashed line P4) at the other extreme, thus defining an angle of rotation A3 of approximately 80 degrees. As arms 133 and 134 move in unison from one extreme to the other, cups 123 move 180 degrees relative to arms 133 and 134. By choosing sprockets 152 and 153 to have a gear ratio of nearly 80:180, precise control over the relative positions of blank 20 storage in magazine 102 and blank 20 disengagement at in-feed opening 17 is attained.

Downward translational movement along path segment 2 of FIG. 1 is provided by pressure-assisted vertical erection mechanism 200, shown in different stages of operation and from various points of view in FIGS. 6 through 10; erection mechanism 200 has indicia from 200 to 299. FIG. 6 is a fragmentary perspective view of the top section of erection mechanism 200, with portable top 12*a* of FIG. 3 partially cut-away, showing folding means comprising the motionless portion of mechanism 200. Two front-end plows 203 and mid-front plow 204, two back-end plows 205 and mid-back plow 206, four fingers 202 mounted one per plow on the surfaces of plows 203 and 205 facing machine walls 13 and 14, and two side plows 207: are all vertically directed and aligned with in-feed opening 17 (see FIG. 3); and cooperate to partially erect a blank into a tray during downward movement of the blank. During drawdown, initial contact with blank 20 is made by fingers 202, which engage amd exert upwardly and inwardly directed forces on minor flaps 21. Then front plows 203 and 204, back plows 205 and 206 and side plows 207 concurrently engage, respectively, fron panel 23, back panel 24 and side flaps 22, and also exert upwardly and inwardly directed forces to erect the respectively engaged blank members. The folding members are arranged so that in the erection process minor flaps 21 are tucked-in first and remain entrapped by side flaps 22. FIG. 7 shows blank 20 at an early stage in the process of being tucked and folded about a quantity of articles 6. The partial folding operation also orients the top portion of blank 20, including cover 26, top flaps 27 and sealing flap 28, in a vertical sense as depicted in FIG. 8. Each side plow 207 abuts the adjacent front-end plow 203 so as to form two rails 208 that act as guides for container corners formed by the junctions of front panel 23 and side flaps 22.

With reference again to FIG. 6, middle front plow 204 is essentially equidistant from machine walls 13 and 14 and is fixedly joined to transversely directed frame member 19, each end of frame 19 being fixedly joined to walls 13 and 14, respectively. The straight vertical side of plow 204, the one opposite the side mounted to frame member 19, lies in a transverse plane parallel to frame member 19 and serves as the transverse datum plane for blank orientation. Blank feed mechanism 100 is adjusted so that when blank 20 is presented at in-feed opening 17 (see FIG. 3), score line 29 between panels 23 and 25 lies in the datum plane.

To accommodate various container sizes, machine 10 of FIG. 1 is provided with convenient width, length and height adjustments. In the preferred embodiment of machine 10, approximately 15 minutes is all the time that is required for adjustments to accommodate a different size container; container sizes may range from 12 inches in width by 10 inches in length by 3 inches in height to 18 inches in width by 15 inches in length by 6 inches in height. To accomplish a width adjustment in the frontal portion of erection mechanism 200, with reference to FIG. 6, front plows 203 are fixedly attached to bores 210 and 211, which are adjustable in-or-out by rotating coupled, oppositely threaded bore shafts 212 and 213. Shaft 212 is pivotally supported by wall mount 214, whereas shaft 213 is similarly supported by another conventional wall mount (not shown) fixedly joined to the inner surface of wall 14. Crank 217 projects through opening 216 in side wall 14 and is coupled to shaft 213. A conventional cranking tool (not shown) is used to manually turn crank 217 clockwise or counterclockwise depending on container width to be accommodated. With reference to FIG. 10, two bores 220 and 221 attached to back plows 205 are adjustable in-or-out on coupled, threaded bore shafts 222 and 223 to accommodate different width containers in the back portion of erection mechanism 200. Shaft 222 is pivotally supported by flange 225, whereas shaft 223 is pivotally supported by flange 226. Both flanges 225 and 226 are mounted in a front-to-back fashion to the ends of transverse crossmember 229. Hangers 227 (one not shown) attach member 229 to the underside of transverse back support member 230. Crank 228 is coupled to shaft 223 and is manually rotatable with the same conventional tool discussed previously to adjust for container width.

To accommodate different length containers in erection mechanism 200, with reference again to FIG. 6, bore 231 is fixedly attached to one end of back support member 230 and is adjustable back-or-forth on rotatable threaded bore shaft 233, which is pivotally supported by fixed side wall flanges 235. FIG. 10 shows the other end of member 230 rigidly attached to bore 232, which is adjustable in-or-out on associated threaded bore shaft 234 pivotally supported by wall flanges 236. This length adjustment arrangement is connected to operate in synchronism with the length adjustment arrangement visible in FIG. 6. Drive chain and sprocket mechanism 237 coupling shaft 233 (FIG. 6) to shaft 234 (FIG. 10) insures adjustment of each end of support 230 occurs in unison. A conventional cranking tool as described above inserted into opening 238 in wall 15 (FIG. 6)

turns crank 239, which is coupled to shaft 234 (FIG. 10) and, thereby compensates for length differences.

Turning now to FIG. 8, the movable component of erection mechanism 200 that effects drawdown is vacuum former 251, which includes: transversely-oriented cantilever 255; two rearwardly projecting hollow crossarms 254 mounted on cantilever 255 using brackets 256; four vertically oriented hollow stanchions 253 (two not shown) joined to crossarms 254 to provide air-tight seals at their junctions; four vacuum receptors 252 (two shown in FIG. 10), each joined in an air-tight seal to a tip of stanchion 253; and air hose 257 that directs vacuum and air supplies to receptors 252 (see FIG. 10) through hollow members 253 and 254. Former 251 is vertically movable from a raised position wherein receptors 252 (see FIG. 10) are adjacent opening 17 to a lowered position adjacent path segment 3 soon to be described. A conventional positive displacement camshaft system, designated the erection cam system and which need not be described insofar as this invention is concerned, is coupled to cantilever 255 and provides timed up-and-down movement for former 251.

With former 251 in the raised position, receptors 252 (see FIG. 10) access and engage the outer surface of bottom panel 25 (not visible) concurrent with the release of blank 20 from cups 123 (see FIG. 3). The transfer of blank 20 from cups 123 (see FIG. 3) to receptors 252 (see FIG. 10) is accomplished under pressure control and, thereby, yields accurate and effortless blank placement.

With former 251 in the lowered position, receptors 252 (see FIG. 10) are below a pair of parallel, laterally disposed tracks 303 rigidly fastened at the bases of front-end plows 203 so that the outer surface of bottom panel 25 (not visible) of the partially erected container rests on the top surfaces of tracks 303. In this position, vacuum to receptors 252 (see FIG. 10) is released and the partially erected container is free for rearward translational movement along path segment 3 of FIG. 1.

Lateral movement along path segment 3 is provided by glue application mechanism 300 shown from various viewpoints in FIGS. 8 through 11; glue application mechanism 300 has indicia from 300 to 399. With reference to FIG. 8, an upstanding T-shaped pusher 302 is prepared to engage the outer surface of front panel 23 of the semi-erected container when it comes to rest on tracks 303 and provide the driving force necessary to move the container along tracks 303. Back-and-forth motion to pusher 302 is provided by a conventional positive displacement camshaft system, hereinafter called the glue cam system and which need not be completely described for purposes of the present invention. However, a sub-component of the glue cam system that controls glue applicator activation and deactivation will be described shortly when FIG. 11 is discussed. Since the glue application mechanism 300 is symmetrically designed, for clarity of presentation the description proceeds by discussing only those components visible in the views of referenced figures with the understanding that if a blank member has a symmetrical counterpart, an essentially identical description applies to the blank member not shown.

Referring now to FIG. 9, the semi-erected container is shown in a position intermediate frontmost and rearmost lateral positions along tracks 303. Cover panel 26 engages three rearwardly inclined, overhead bars 323 and 324, which downwardly fold all members of the top portion of blank 20. Top flap 27 is ready for contact with the inclined segment of rearwardly directed side folding rod 322. Also, as the semi-erected container slides along tracks 303, side panel 22 is held upright by winged, vertically oriented, rearwardly projecting abutments 325 rigidly fastened to tracks 303.

The lateral position of the container as shown is such that angularly oriented, pressure-assisted glue application station 341 adjacent track 303 is ready for activation to project adhesive on the lower portion of side flap 22. Both glue station 341 and associated glue gun 342 are components of a conventional glue application system 340 (see FIG. 15). In the preferred embodiment, the glue application system is a commercially available system manufactured by NORDSON CORPORATION, Amherst, Ohio, called the Hot Melt Applicator Model V as described in Technical Bulletin 41-5-0 issued Dec. 9, 1975 and includes glue gun Model H-20A and nozzle with Part Number 231-214. A conventional air hose arrangement connects the system to an installation-provided air supply of 70 to 100 pounds per square inch (psi). Important adhesive characteristics of said system comprise: adhesive is emitted at a temperature which may range from 325 to 400 degrees F. and is typically 375 degrees F. viscosity may range from 800 to 2500 centipoises and is typically 2000 centipoises; and glue curing may take from 1 to 10 seconds and typically takes about 1 to 3 seconds.

Glue application station 341 is adjusted so that associated glue gun 342 is aimed at an acute angle relative to the lateral movement along track 303. The angular orientation of gun 342 determines a plane of projection for glue stream 343 emitted by gun 342. FIG. 12 shows a geometric representation of the view of the plane of projection, designated P5, relative to plane P0 (see FIG. 1) as well as to both the lateral movement and transverse direction along path segment 3. The acute angle, designated B1, between plane P5 and the transverse direction is fixed at a value in the range 20 to 70 degrees and is preferably 60 degrees.

Turning attention to FIG. 9, as back container corner 31 formed at the junction of back panel 24 (not visible) and side flap 22 passes gun 342, glue application station 341 is activated so as to apply glue from gun 342 via stream 343 to side flap 22 starting approximately 0.5 inches from corner 31. During activation of glue station 341, a constant pressure S1 between 20 and 40 psi, typically 30 psi, is supplied to glue system 340 (see FIG. 15) which, in turn, supplies glue at a first constant pressure to glue station 341.

As front container corner 32 formed at the junction of side flap 22 and front panel 23 approaches gun 342, it is deactivated to stop glue dispensing approximately 0.5 inches from corner 32. During deactivation, the constant pressure supplied to glue system 340 (see FIG. 15) is increased to pressure S2, which is generally between 30 and 60 psi and is typically 45 psi, thereby increasing glue pressure supplied to glue station 341 to a second constant pressure. The reason for the increased pressure is explained shortly. Referring to FIG. 10, as front corner 32 departs gun 342, it is reactivated to apply stream of adhesive 343 to front panel 23 starting approximately 0.5 inches from corner 32. Due to strategic angular placement, guns 342 simultaneously but from opposing directions apply adhesive on front panel 23. As the container continues lateral movement, two adhesive streams 343 converge towards the center of panel 23, whereupon guns 342 are deactivated prior to overlap of the individual streams. Typically streams 343 converge to the point of essentially touching each other although in some applications it may suffice to glue only two-thirds of front panel 23.

Increased pressure S2 is supplied during the second gluing activity so as to apply approximately the same amount of glue per unit length on front panel 23 as on side flaps 22. During glue application to side flap 22, the distance between the surface receiving glue and gun 342 remains constant. However, during glue application to front panel 23, the complete surface that is to receive glue is exposed and is moving away from gun 342 due to the transverse orientation of front panel 23 relative to lateral movement of the container along path segment 3. Thus the time available to apply glue to a unit length of front panel 23 is less than the time available per unit length for side flap 22. To compensate for the shorter time available, a greater volume of glue per unit time must be delivered to front panel 23. Since the nozzle opening of gun 342 is fixed, increased pressure S2 forces more glue through the nozzle per unit time, thereby increasing volume as well as velocity. Increased velocity compensates for stream bending due to gravity and allows panel 23 to intercept stream 343 at the prescribed height.

An additional compensating factor relating to time of application is that the glue cam system decreases the speed of the container along path segment 3 as glue is applied to front panel 23. The average speed of the container in its complete traversal of path segment 3 is about 24 inches per second (ips) for a packaging cycle of four seconds. However, while glue is being applied to side flap 22, the lateral speed ranges from 22 to 26 ips depending on the position of the container along path segment 3. Moreover, while glue is applied to front panel 23, the lateral speed ranges from 20 to 24 ips, with the lowest rate corresponding to the stage at which overlap of streams 343 is imminent.

Returning to the mechanical description of glue mechanism 300 shown in FIG. 10, concurrent with glue application to front panel 23, continuing movement of the semi-erected container causes top flap 27 to engage the bottom, horizontal segment of bar 322, thereby folding flap 27 downwardly at approximately a 30 degree angle relative to side flap 22. To accomplish this angular relationship, bar 322 is offset in the outward transverse direction with respect to underlying track 303. As movement proceeds, bars 323 and 324 disengage cover 26, but forwardly projecting, downwardly directed bars 326 engage cover 26 to maintain its horizontal orientation. Bars 326 are required in order to accommodate containers of different heights and insure that front panel 23 does not partially return to a flattened position due to inherent springiness in the stressed score lines after pusher 302 is removed. This partial unfolding may lead to loss of entrapment of front minor flaps 21 (not visible) and result in crushing of the container as it is raised into compression along path segment 4 soon to be described. Ribs 327 mounted upright on the bottom segment of bar 322 similarly insure that top flap 27 binds side flap 22 when bar 322 loses contact with flap 27 during ascent into compression.

To accommodate containers of different widths, two adjustments to glue mechanism 300 are provided. In the first case, since bars 323 are rigidly fastened to back-end plows 205, adjustment of bars 323 occurs automatically whenever erection mechanism 200 is adjusted, as previously described. Similarly, bar 322 is rigidly connected via flange 328 to back plow 205, so bar 322 is adjusted whenever plow 205 is adjusted. In the second case, due to the rigid interconnection of the frontmost ends of tracks 303 with plows 203 (not visible), the width of the frontal section of tracks 303 is automatically adjusted whenever plows 203 are adjusted. The rearmost ends of tracks 303 are attached to a conventional bore-threaded shaft arrangement (not shown) similar to the one describe with respect to width adjustment of front-end plows 203. In fact, a conventional gear and chain drive (not shown) links front-end threaded shaft 213 (see FIG. 6) with said rearmost bore-threaded shaft arrangement to enable simultaneous width adjustment to the rearmost ends of tracks 303.

To accommodate various container heights, bars 326 are up-or-down slidably adjustable with screws 329, which screw into fixed, rigid hangers 415. The supporting arrangement for hangers 415 will be discussed shortly.

Referring now to the perspective view of FIG. 11, which is a showing of glue control mechanism 360, the components that control activation and deactivation of glue stations 341 are depicted. Bushing 361 is mounted in slidable relation on fixed, parallel, laterally disposed guide bars 362 and is driven laterally to-and-fro via the same conventional positive displacement camshaft system that propels pusher 302. Fixedly joined to bushing 361 is trip mechanism 370, which comprises a notched plate 371, elongated length adjustment plate 372 and width adjustment plate 373. Both plates 372 and 373 are independently slide adjustable to accommodate different length and width containers, respectively. An electrical microwswitch 706 (shown dashed) having lever arm 707 to control the on-off state of switch 706 is positioned so as to contact the underside of trip mechanism 370 during its back-and-forth excursions. The various indentations along the underside of trip mechanism 370 cause alternately on-off switch action, as now described. With bushing 361 initially in the frontmost section of path segment 3, that is, adjacent path segment 2 (left-hand side of FIG. 11), switch 706 is off. It remains off until forwardly moving (towards the right in FIG. 11) front plate 372 strikes lever 707 and closes switch 706. It remains closed while bushing 361 travels a distance denoted L, which is set according to container length. During the associated time interval, glue is applied to side flaps 22 (see FIG. 9). Next, switch 706 turns off for a time determined determined by fixed notch distance D in plate 371; length D is about 1.5 inches corresponding to an off-time of approximately 55 milliseconds. This is the period, with reference to FIG. 10, in which front corner 32 is passing glue guns 342 and pressure is being increased to S2. Then, referring to FIG. 11, switch 706 closes for a time determined by distance W, which is set according to container width. This is the interval, with reference to FIG. 10, during which glue is applied to approximately one-half front panel 23 by each gun 342. Finally, referring to FIG. 11, switch 706 opens to deactivate guns 342 (see FIG. 10) and restore lower pressure S1. It is possible to speak of time intervals determining distance intervals and vice versa since guns 342 can be turned on and off at a rate that is considerably faster than the rate at which the containers move past guns 342. Another switch (not shown in FIG. 11, but described in the electrical section) placed in series with switch 706 insures that switch 706 can activate, with reference to FIG. 10, each gun 342 only when a container is engaged by pusher 302.

On the back of bushing 361 of FIG. 11 is fastened a fixed striker plate (not shown) that controls on-off action of a third switch (not shown in FIG. 11, but described in the electrical section). This latter switch controls which pressure, S1 or S2, is supplied to glue application system 340 (see FIG. 15). While off, S1 is supplied and when activated, S2 is supplied. This third switch is off until tripped by the fixed striker plate during the time interval associated with distance interval D of notched plate 371.

At the completion of translational movement along path segment 3, a fully-glued, almost completely folded container rests on the rearmost ends of tracks 303, whereupon translational movement along path segment 4 commences.

Upward translational movement along path segment 4 of FIG. 1 is provided by compression mechanism 400 shown in FIG. 10; compression mechanism 400 has indicia from 400 to 499. The movable portion of compression mechanism 400 is platform-like elevator 401, which operates in the region between tracks 303 and which is movable from a lowered position under the plane of tracks 303 adjacent the rearmost end of path segment 3 to a raised position internal to vertically-oriented, four-walled compression chamber 410. Up-and-down movement for elevator 401 is provided by a conventional positive displacement camshaft system, designated the compression cam system, and which need not be described insofar as the present invention is concerned.

Chamber 410 is defined by: transverse front chamber wall 412; two similar, laterally-oriented side chamber walls 414 (one not shown); and a back chamber wall (not shown). Wall 412 has an outwardly sloped lower portion **412*a* that gradually directs sealing flap 28 into firm contact with glued front panel 23 during ascent. Similarly, wall 414 has outwardly sloped lower portion 414*a* to ease top flap 27 into firm contact with glued side flap 22. As discussed shortly, side walls 414 and the back chamber wall are adjusted to exert a holding force on flaps 27 and 28** so that they press against the glued blank members during curing.

Upon descent of elevator 401, a previously raised container is retained in chamber 410 by four spring-loaded latches 422 (two not shown) built into side walls 414. The latches are pushed aside by an ascending container, but spring back to support bottom panel 25 (not visible) and hold the container in place in chamber 410.

One or more containers may be accumulated in chamber 410 depending upon the height of the sealed containers being processed. The most recently erected container is lifted by elevator 401 and raises the stack in chamber 410. This lifting action causes the top container to be raised to the ejection portion of path segment 5 soon to be discussed. The back chamber wall is not as tall as the remaining chamber walls since only non-glued back panel 24 (not visible) need engage the back chamber wall. This reduced height allows the topmost container in the stack to clear the back chamber wall so that ejection of the sealed container may take place in a rearward, lateral direction.

To allow for different width and length containers in chamber 410, side walls 414 and the back chamber wall, respectively, are adjustable. All adjustments are made relative to permanently placed front wall 412, which is rigidly fastened to hangers 415 in turn supported by a transverse frame crossmember (not shown). In describing a width adjustment, attention is focused on side wall 414 visible in FIG. 10, with the realization that a similar description applies to the other side wall 414 not shown.

Hangers 417 and 418 support side wall 414. The top of hanger 417 is mounted to a first transverse bore-threaded shaft arrangement similar to those previously described. Also, the top of hanger 418 is fixed to a second transverse bore-threaded shaft arrangement. The first and second bores move in-or-out in the transverse direction whenever the corresponding shafts are suitably rotated. The first and second threaded shafts are coupled with a gear and drive chain mechanism so that both bores are jointly adjustable. The first threaded shaft is coupled to manual crank 420 through hole 419 in machine wall 14 to provide for a convenient width adjustment.

The lower portion of the back chamber wall extends below chamber walls 412 and 414 so as to form an end-stop at the rearmost portion of path segment 3. For length adjustments, the back chamber wall is then movable in-or-out in a manner described in the next paragraph.

Translational movement along inclined path segment 5 is provided by a discharge mechanism comprising a conventional hook-like, overhead puller (not shown) and conventional wheel-provided, gravity conveyor 501 as depicted in FIG. 5; the discharge mechanism has indicia from 500 to 599. The puller is movable laterally to-and-fro in machine 10 of FIG. 1 and is driven by a conventional camshaft system, designated the discharge cam system, and which need not be described for the purposes of this invention. Referring to FIG. 10, the puller is positioned laterally overhead of chamber 410 and engages a sealed container on the surface formed by front panel 23 and sealing flap 28 (both not visible) as it emerges from compression chamber 410. Turning to FIG. 5, the puller moves the container onto conveyor 501, whereupon the container rolls to and through output opening 18 in back wall 16. The end of conveyor 501 internal machine base 11 and the back chamber wall are fixedly joined. Both the back chamber wall and conveyor 501 are adjustable in-or-out via a bore-threaded shaft arrangement much like those previously described to accommodate various length containers. Crank 502 provides manual access to rotate the threaded shaft.

To succintly describe the synchronized operation of machine 10, reference is made to FIG. 13, which shows the timing diagram of one packaging cycle superimposed on the chart of relative cam movements of the five cam systems defined in the preceding detailed description. As summarized on the ordinate of FIG. 13, these systems are: blank feed; erection; glue; compression; and discharge. As shown on the bottom abscissa, the time for one complete packaging cycle is, preferably, 4 seconds. Also, machine 10 is designed so that a single rotation of each cam system is equal to a single packaging cycle. Hence, the top abscissa depicts mechanical rotation as ranging from 0 to 360 degrees. The stage of a packaging cycle that serves as reference is that instant wherein the blank feed mechanism 100 (see FIG. 3) has just released a blank at in-feed opening 17 (see FIG. 3) and blank feed motion is impending; this instant in time is arbitrarily defined as the zero time reference, and all other times of a cycle are relative to this zero time reference. Similarly, the location of the blank feed cam system at time zero is defined as the zero rotational reference point for the five cam systems. For purposes of discussion relating to FIG. 13, rather than continually referring to both time and rotational movement, it is sufficient to couch the discussion in terms of time since rotational movement is directly related to time since 90 degrees of rotation requires 1.0 seconds. Also, the mechanical rotational chart is intended to convey the times during which movement of the cam systems is occurring, and is not intended to depict relative displacements or locations since movements of the different cams are not necessarily uniform. Furthermore, the particular mode of operation depicted by FIG. 13 is the one wherein former 251 (see FIG. 8) pauses at its elevated position adjacent in-feed opening 17 (see FIG. 8) to receive articles for packaging.

With reference to the blank feed portion of FIG. 13 and cross-referencing to FIG. 3, the blank feed cam system moves blank feed mechanism 100 backwards along the first path segment for about 1.333 seconds to a dwell position over opening 17 lasting about 1.333 seconds. Then, for 1.0 second, blank feed mechanism 100 moves forward along the first path segment while grasping a blank to a dwell position lasting about 0.333 seconds. At approximately 2.222 seconds, suction cups 123 are provided with vacuum for blank pick-up, whereas at about 3.667 seconds vacuum is released and a pulse of air is expelled for 5 milliseconds through cups 123.

With reference to the erection portion of FIG. 13 and cross-referencing to FIG. 8, the erection cam system waits about 1.333 seconds with former 251 in the raised position while grasping flat blank 20. During this interval, the articles to be packaged are loaded onto the blank. In the next 1.0 seconds, former 251 descends along the second path segment to reach its lowered position. After a dwell of about 0.667 seconds, former 251 begins its ascent to in-feed opening 17. At about 2.222 seconds, vacuum to receptors 252 (see FIG. 10) is released and a 5 millisecond puff of air is expelled through receptors 252. At about 3.667 seconds, vacuum is provided to receptors 252 to receive blank 20 from blank feed mechanism 100 (see FIG. 3).

With reference to the erection portion of FIG. 13 and cross-referencing FIG. 8, the glue cam system moves to-and-fro on the third path segment in equal time intervals of about 1.444 seconds. Dwell time in the forward position adjacent the second path segment is about 1.111 seconds. Pusher 302 is activated at about 2.222 seconds to move the semi-erected container forward along the third path segment, thereby clearing the container from erection mechanism 200 before former 251 begins ascent.

With reference to the compression portion of FIG. 13 and cross-referencing FIG. 10, elevator 401 of the compression cam system begins upward movement along the fourth path segment immediately after the semi-erected container reaches the rearward portion of the third path segment. The ascent lasts about 1.111 seconds, followed by about a 0.444 seconds dwell in its raised position internal chamber 410. Downward movement of elevator 401 lasting about 1.111 seconds is completed just as pusher 302 starts the next container on its lateral path; elevator 401 remains stationary during pusher 302 forward traversal.

Finally, with reference to the discharge portion of FIG. 13 and cross-referencing FIG. 10, the puller of the discharge cam system begins ejection of a sealed container along the fifth path segment about 0.222 seconds after elevator 401 begins its descent. The top container in the stack is pulled forward for about 1.111 seconds and is ultimately delivered to conveyor 501 (see FIG. 5). The puller returns in about 1.111 seconds to await the next sealed container; waiting time is about 1.777 seconds.

Other specific information of interest may be readily deduced from perusal of FIG. 13.

2. Vacuum and Air Circuits Descriptions

FIG. 14 shows a schematic diagram of the interrelated vacuum and air circuits of the preferred embodiment of the present invention, as now described.

Vacuum circuit 600 includes conventional vacuum pump 601, conventional four-way spool valve 602, conventional open-close valve 603 and pneumatic hoses 604 and 605. Throughout the discussion of vacuum circuit 600, cups 123 are discussed with reference to FIG. 3 whereas receptors 252 are discussed with reference to FIG. 10. In the preferred embodiment of the present invention, pump 601 is a commercially available pump manufactured by GAST MANUFACTURING CORPORATION, Benton Harbor, Michigan called the Gast Oil-less Model 0822-V103-G273. Valve 602 is also commercially available from ALKON PRODUCTS, Wayne, New Jersey and is Model A7980-1/4 DS. Valve 603 is any standard coil-operated, open-close pressure valve.

In order to shift vacuum from cups 123 to receptors 252, spool valve 602 is used under control of two electrical coils 726 and 727. When coil 726 is energized, the spool mechanism internal to valve 602 moves to one end and remains at this end after the coil is de-energized. This first end position is depicted by the solid schematic lines internal valve 602, in which input port IA2 is connected to output port OA2 and center input port IA is connected to output port OA1. Coil 727, when energized, moves the spool to the other end to redirect pressure flow, and the spool remains at the other end after coil 727 is de-energized. This second end position is depicted by the dashed schematic lines internal valve 602, in which input port IA1 is connected to OA1 and IA is connected to OA2. In order to shift a valve, only a pulse of current to either coils 726 or 727 is necessary. Air pressure applied to the center input port IA of the valve does the work of shifting when a coil gives the signal to shift.

To see how valve 602 effects a transfer of blank 20 from cups 123 to receptors 252, the present stage of operation of machine 10 of FIG. 1 is presumed to be such that: spool valve 602 is directing pneumatic inputs according to the solid schematic lines of valve 602; and coil 724 is energized so that valve 603 blocks air flow from air circuit 650. Thus, vacuum is being supplied to cups 123 from pump 601 via output port OA2, input port IA2 and hoses 604 and 125; also, port IA has no external pressures applied through hose 605. With reference to FIG. 13, this stage exists during the interval from about 2.222 seconds to 3.667 seconds. Turning back to FIG. 14, at about 3.667 seconds, coil 727 is energized and coil 724 is de-energized. Spool valve 602 now shifts so that vacuum is directed to receptors 252 from pump 601 via output port OA1, input port IA1 and hoses 604 and 257. Simultaneously, air from input IA is directed to cups 123 through OA2 and is expelled for the approximately 5 milliseconds that valve 603 remains open. To release vacuum on receptors 252 and redirect it to cups 123, at about 2.222 seconds into a packaging cycle, coil 726 is energized at the same time coil 724 is de-energized. A puff of air is also directed to receptors 252 by allowing air to pass through valve 603 for 5 milliseconds.

Regarding air circuit 650, a house or installation provided air supply of 70 to 100 psi, typically 80 psi, is accessed via pneumatic hose 670. Hoses 671, 672 and 674 direct the air supply to valves 603, 651 and 657, respectively, while hose 673 directs air to valves 655 and 656.

Valve 651 is a conventional four-way valve operated by single coil 725. With coil 725 de-energized, air is directed from input port IB to output port OB2 via the dashed line schematic path. Energizing coil 725 causes air to be directed from IB to output port OB1 via the solid line schematic path. Valve 657 is also a conventional four-way valve controlled by coil 721 and is used in a mode similar to valve 651. Valves 655 and 656 are conventional open-close valves controlled by coils 722 and 723, respectively.

Valve 651 directs low pressure S1 or high pressure S2 to glue system 340. With coil 725 deactivated, air reaches low pressure regulator 653 through the path comprising hoses 670 and 672, IB to OB2 internal valve 651 and hose 676. Regulator 653 provides pressure S1 in the range 20 to 40 psi and is typically 30 psi to glue system 340 through check valve 660 and hoses 677 and 678. With coil 725 energized, air reaches high pressure regulator 652 through the path comprising hoses 670 and 672, IB to OB1 internal 651 and hose 675. Check valve 660 blocks high pressure from the low pressure path. Regulator 652 provides pressure S2 in the range 30 to 60 psi and is typically 45 psi to glue system 340 through hose 677.

Air pressure provides the force necessary to open the nozzle associated with guns 342 (see FIG. 9) to emit glue. Valve 655, under control of energized coil 722, passes air to one gun 342 through hoses 670, 673 and 679. Similarly, valve 656, under control of energized coil 723, passes air to the other gun 342 through hoses 670, 673 and 680.

Valve 657 controls a conventional air clutch 658, which is air-activated to couple electrical drive motor 701 (see FIG. 15) to a main camshaft for rotation of the five positive displacement cams. In the preferred embodiment, clutch 658 is commercially available from TOL-O-MATIC, INC. of Minneapolis, Minnesota and is Model Tol-O-Matic. Valve 657 also controls a conventional two-position air latch 659, which is an air-activated mechanism that stops the main camshaft at a predetermined, repeatable position in a packaging cycle. In the preferred embodiment, latch 659 is a Skinner Air Valve Model H95-DB-2150 available from SKINNER PRECISION INDUSTRIES, INC. of New Britain, Connecticut.

With coil 721 de-energized, air pressure is directed to the first position of latch 659 which causes a mechanical break associated with latch 659 to seize the main camshaft. The air path is established via input port IC, output port OC2 and hoses 670, 674 and 682. With coil 721 energized, air pressure is redirected to the second position of latch 659 which causes the mechanical break to release the main camshaft. Now the air path is established via IC, output port OC1 and hoses 670, 674 and 681. This path also directs air to clutch 658, which couples drive motor 701 (see FIG. 15) to the main camshaft to effect rotational movement.

3. Electrical Circuit

FIG. 15 shows the electrical schematic of the preferred embodiment of the present invention, as now described.

Machine 10 of FIG. 1 requires an installation-provided three-phase, 230 volts, 60 Hz power source 760. The three-phase power is necessary for the preferred glue system 340 and the preferred vacuum pump 601 both previously described. Circuit breakers 761, 762 and 763 in series with each of the phase wires of source 760 are controlled by a handle external to machine 10 and arranged in such a way that internal access to machine 10 is allowed only if the handle opens breakers 761, 762 and 763. Power source 760 is protected with fuses 772 which are rated at 30 amperes. A single-phase, 230 volts, 60 Hz supply for DC motor 701 and associated DC control pack 702 is tapped-off of three-phase source 760. In the preferred embodiment, DC motor 701 is commercially available from BROWNING MANUFACTURING of Maysville, Kentucky and is of the permanent magnetic type having Model Number 100 DC 56EC2. The associated power pack 702, Model LW 100/150 also available from BROWNING, provides motor speed control. Circuit modifications to pack 702 are made so as to have complete control of motor 701 from an operator's console 720 (see FIG. 3). The electrical modifications which replace the on-off, start-stop functions of pack 702 are given in sub-diagram 703.

A low voltage, single-phase, 60 Hz supply is provided by tap-off transformer 251, which drops one 230-volt phase to 117 volts. Fuse 771 limits the current in the low voltage circuit to 10 amperes.

Provisions for two distinct ways of operating machine 10 are incorporated into the electrical circuitry. One is the fully automatic way in which, once activated, cycle-after-cycle is repeated without operator intervention. In the preferred embodiment, the speed of motor 701 is adjusted for 15 revolutions per minute or one packaging cycle every 4 seconds. The other way of operation is one wherein each packaging cycle must be triggered manually. Once triggered, one packaging cycle lasting 4 seconds is completed, and then container movement stops to await operator activation of the next cycle.

Each way of operation is now described with the completely automatic way treated first.

It is presumed air supply 670 and power supply 760 are connected and breakers 761, 762 and 763 are closed and glue warm-up is complete, so that automatic operation is initialized and proceeds as follows:

(a) normally-open switch 716 is closed to energize coil 721, thereby releasing the main camshaft for rotation. All five cam systems are now in motion, but containers are not yet being processed because the erection and glue systems must be activated;

(b) normally-open switches 714*a* and 714*b*, both ganged to form a first console switch, are closed. Normally-open switches 715*a* and 715*b*, also both ganged to form a second console switch, are closed. Normally-open push-button switches 713*a*, 713*b* and 713*c*, all ganged to form a third console switch, are momentarily closed. Glue relay 741 is now energized, thus closing contact 742 associated with relay 741 so that switches 713*a*, 713*b* and 713*c* may be released. Containers still are not being processed because the erection system is not activated;

(c) normally-open switch 711 is closed and normally-open push-button switch 712 is momentarily closed, thereby energizing relay 731 and closing contact 732 associated with relay 731 so that switch 712 may be released. Relay contacts 733, 734 and 735 also associated with relay 731 start vacuum pump 601. Pump 601 remains energized until switch 711 is opened;

(d) normally-closed switches 708*a* and 709*a* energize coil 724 to close valve 603 (see FIG. 14). Also, normally-open switches 708*b* and 709*b* de-energize coils 726 and 727, respectively, associated with spool valve 602 (see FIG. 14). A trip lever mounted on the rotating main camshaft triggers ganged switches 708*a* and 708*b* simultaneously to direct vacuum to cups 123 (see FIG. 3) and a puff of air to receptors 252 (see FIG. 10) according to the timing diagram of FIG. 13. Similarly, a main camshaft mounted trip lever triggers ganged switches 709*a* and 709*b* simultaneously to redirect vacuum to receptors 252 and a pulse of air to cups 123 at the appropriate time in the cycle;

(e) normally-open switch 705 is closed whenever a container is present in glue application mechanism 300 (see FIG. 8). The closing of normally-open switch 706 by trip mechanism 370 (see FIG. 11) energizes coils 722 and 723 for glue application. Similarly, the closing of normally-open switch 704 by the striker on the back of bushing 361 (see FIG. 11) energizes coil 726 to increase pressure to glue system 340;

(f) automatic container erection and sealing is now ongoing until switch 714*a*, which stops gluing, and switch 711, which stops blank pick-up, are both opened. Opening switch 716 stops main camshaft rotation.

Activation of the manual way of operation differs from the automatic way in step (a) above, which becomes step (a'), as follows:

(a') normally-open switch 716 is never closed. Now normally-closed switch 710 energizes coil 721, but only until a trip lever on the main camshaft opens switch 710. If both switches 713*a* and 717 are open, the main camshaft stops rotation due to seizure by the mechanical break of latch 659 and decoupling motor 701 from the main camshaft by deactivating clutch 658. The stopping point is controlled by adjusting the main camshaft location of the trip lever associated with switch 710, and the point typically corresponds to former 251 (see FIG. 8) being either in its elevated position or in its partial drawdown position to await loading of articles. To cycle machine 10 of FIG. 1, either push-button switch 713*a* or foot pedal switch 717 is momentarily closed so as to cause main camshaft rotation, thereby closing switch 710 for the duration of one packaging cycle.

It will be further understood that the automatic packaging machine herein described is not limited to specific forms disclosed by way of example and illustration, but may assume other forms, materials or dimensions limited only by the scope of the appended claims.

What is claimed is:

1. A method for gluing a blank having a side flap in a first plane and a panel in a second plane disposed in normal relation to said first plane, comprising the steps of:

moving said blank in a direction;

placing at least one glue applicator adjacent said direction;

aiming said at least one applicator at one acute angle relative to said direction; and operating said at least one glue applicator to dispense glue on said side flap and on said panel during said step of moving said blank in said direction.

2. Apparatus for erecting a blank into a sealed container comprising in combination:

means for moving said blank in a first direction defining a first route;

first folding means located adjacent said first route to engage said blank to form a partially erected container;

means for advancing said partially erected container in a second direction normal to said first direction thus defining a second route;

second folding means located adjacent said second route to engage said partially erected container to form a semi-erected container;

at least one adhesive applicator adjacent said second route and aimed at an acute angle relative to said second direction;

means for operating said at least one adhesive applicator to apply adhesive to all of the surfaces of said partially erected container requiring adhesive during movement of said partially erected container in said second direction;

means for transporting said semi-erected container in a third direction normal to said second direction and parallel to said first direction thus defining a third route;

third folding means located adjacent said third route to engage said semi-erected container and form said sealed container;

means associated with said moving means, advancing means and transporting means for providing synchronized and sequential transfer of said blank from said moving means to said advancing means and then to said transporting means.

3. The combination in accordance with claim 2 wherein there is connected to said apparatus means for transferring said blank from a storage location to a starting position associated with said moving means.

4. Apparatus as recited in claim 2 for erecting said sealed container from said blank having a first flap in a first plane and a second flap in a second plane, wherein said at least one adhesive applicator is constructed and arranged to be pressure responsive to at least a first pressure and a second pressure, said operating means provides said first pressure to said at least one adhesive applicator for dispensing adhesive on said first flap, and said operating means provides said second pressure to said at least one adhesive applicator for dispensing adhesive on said second flap.

5. Apparatus for folding a blank having a side flap and a front panel into a sealed container comprising in combination:

means for moving said blank in a first direction defining a first route;

first folding means located adjacent said first route to engage said blank to form a partially erected container;

means for advancing said partially erected container in a second direction normal to said first direction thus defining a second route;

second folding means located adjacent said second route to engage said partially erected container to form a semi-erected container;

at least one adhesive applicator adjacent said second route and aimed at an acute angle relative to said second direction with said at least one adhesive applicator constructed and arranged to be pressure responsive to at least a first and second pressure;

means for operating said at least one adhesive applicator to apply adhesive to the surfaces of said partially erected container requiring adhesive during movement of said partially erected container in said second direction, said operating means providing said first pressure to said at least one adhesive applicator for dispensing adhesive on said side flap, and said operating means providing said second pressure to said at least one adhesive applicator for dispensing adhesive on said front panel, said first and said second pressure related so that said second pressure is at least as great as said first pressure;

means for transporting said semi-erected container in a third direction normal to said second direction and parallel to said first direction thus defining a third route;

third folding means located adjacent said third route to engage said semi-erected container and form said sealed container;

means associated with said moving means, advancing means and transporting means for providing synchronized and sequential transfer of said blank from said moving means to said advancing means and then to said transporting means.

6. Apparatus as recited in claim 5 wherein said second pressure is substantially greater than said said first pressure and said acute angle is substantially 60 degrees.

7. A machine to fold a blank having panel and flap members that define a container when folded during operation of said machine, comprising in combination:

a base housing having an in-feed opening and an output port, said in-feed opening defining a plane P1;

storage means attached to said base housing adjacent said in-feed opening for storing at least one said blank for use in said machine, said storage means generally defining a plane P2;

a starting position adjacent said in-feed opening;

means for transferring said blank from said storage means said starting position, said transfer means connected to said machine and comprising:

(a) pivoting means mounted to said base housing comprising at least one arm having one end pivotally mounted to said base housing to pivot about an axis R1 so that the free end is rotatable between a first position adjacent said storage means and a second position adjacent said in-feed opening;

(b) support means rotatably mounted to said at least one arm and parallel said axis of rotation R1 thus defining with said axis R1 a plane P4 so that in said first position said plane P4 is substantially parallel to said plane P2 and in said second position said plane P4 is substantially parallel to said plane P1, and said plane P4 rotates through an angle A1 between said first and second positions;

(c) turning means constructed and arranged in relation to said base housing and said support means for rotating said support means through an angle A5 as said at least one arm moves between said first and second positions;

(d) at least one vacuum cup joined to said support means to rotate therewith so as to grasp, when directed, one said blank from said storage means while said at least one arm is in said first position and to transfer said blank from said first to said second position;

a source of air pressure and a source of vacuum, both said sources alternately in communication with said cup such that when said cup is adjacent one said blank in said storage means, said source of vacuum is directed to said cup causing said blank to be grasped by said cup, whereas when said cup is adjacent said in-feed opening, said source of vacuum is released and a pulse of said souce of air is directed to said cup causing release of said transferred blank at said in-feed opening;

means for moving said blank from said starting position in a first direction defining a first route, said moving means comprising:

(i) a former vertically movable within said base housing between a raised location adjacent said in-feed opening and a lowered location within said machine;

(ii) at least one vacuum receptor secured to said former for movement therewith, both said sources in alternate communication with said receptor so that when said transferred blank is present at said in-feed opening, said former is in said raised location and said source of vacuum is directed to said receptor to grasp said transferred blank, whereas with said former in said lowered location, said vacuum to said receptor is released and an air puff from source of air is directed to said receptor to cause release of said transferred blank grasped by said receptor;

first folding means interposed within said base housing and disposed intermediate said raised and lowered locations to engage at least one said panel and flap members to form a partially erected container as said former is moved from said raised to said lowered location;

means for advancing said partially erected container in a second direction normal to said first direction thus defining a second route, said advancing means comprising: guide means having a stop position and located within said housing adjacent said lowered location of said former for receiving said partially erected container from said former and for advancing said partially erected container within said machine to said stop position;

second folding means interposed within said base housing and located adjacent said guide means to further engage and fold at least one said flap and panel members and form a semi-erected container as said partially erected container advances due to said guide means;

third folding means comprising a chamber within said base housing located above said stop position;

means for transporting said semi-erected container in a third direction normal to said second direction and parallel to said first direction thus defining a third route, said transporting means comprising: an elevator vertically movable between a bottom position within said base housing to an elevated position within said chamber to lift said semi-erected container from said stop position for deposit within said chamber wherein the walls of said chamber complete final folding to form a fully erected container;

discharge means for removing said fully erected container from said chamber and for ejecting said folded container from said base housing through said output port; and wherein said moving means, advancing means, transporting means and, in addition, said pivoting means and said discharge means are constructed and arranged to effect synchronous transfer of said blank from said pivoting means to said moving means, from said moving means to said advancing means, from said advancing means to said transporting means and from said chamber to said discharge means.

8. A machine as recited in claim 7 wherein said angle A1 is about 80 degrees and said angle A5 is about 180 degrees.

9. A machine as recited in claim 7 wherein said turning means comprises:

a first sprocket having N1 teeth and fixedly attached to said base housing;

a second sprocket having N2 teeth and fixed to said support means for rotating said support means through said angle A5 and such that said first and second sprockets have a gear ratio N1/N2;

a chain linking said first and second sprockets to cause said second sprocket to turn said support means through said angle A5 as said arm is pivoted about said axis R1 through said angle A1 so that said gear ratio is about A5/A1.

10. A machine as recited in claim 9 wherein A1 is about 80 degrees and said angle A5 is about 180 degrees so said gear ratio N1/N2 is about 180:80.

11. A machine as recited in claim 7 wherein said pivoting means comprises a first and a second arm and wherein said support means is a shaft having one end rotatably mounted to said first arm and the other end rotatably mounted to said second said arm, and with two said arms, said shaft and said axis of rotation R1 generally defining said plane P4.

12. An automatic machine for storing, feeding, folding, and gluing a scored blank into a container during machine operation, said machine comprising:

a base housing having an in-feed opening and an output port, a blank storage magazine mounted on said housing, pivot arms mounted on said housing and movable between a raised position adjacent said magazine and a lowered position adjacent said in-feed opening, first means mounted on said pivot arms for engaging and releasably retaining said blank thereon for movement therewith, a former interposed within said housing and vertically movable from an elevated position adjacent said in-feed opening to a retracted position within said housing, second means for engaging and releasably retaining said blank present at said in-feed opening, said second means mounted on said former for movement therewith, said pivot arms and said former constructed and arranged in synchronism to effect a transfer of said blank from said magazine to said second means, first folding means mounted within said housing for engaging said blank to partially erect said blank during its descent on said former, horizontal guide means adjacent said retracted position of said former having a preselected stop position, pusher means engageable with said partially erected blank for moving said blank from said retracted position onto and along said guide means until said stop position is reached, second folding means mounted adjacent the periphery of said guide means to further fold said blank into a semi-erected container during movement of said blank under control of said pusher, at least one adhesive applicator interposed within said housing and positioned at an acute angle relative to the path of motion of said blank along said guide means, said applicator adjacent the path of movement along said guide means, and means comprising said at least one applicator constructed and arranged to apply adhesive to selected portions of said blank including all of the surfaces requiring adhesive as it undergoes movement in one direction along said guide means by said pusher, a compression chamber disposed within said housing adjacent said end position of said guide means, elevator means within said housing for engaging and vertically raising said semi-erected container into said compression chamber wherein said scored blank is held under compression force by the walls of said chamber to form a completely folded container, means for retaining said semi-erected container in said chamber after said elevator has descended from said chamber;

discharge means for removing said folded container from said chamber and for ejecting said folded container from said base housing through said output port, and means associated with said pivot arms, former, pusher means, elevator means and discharge means for sequentially and synchronously moving said arms, former, pusher means, elevator means and discharge means during said machine operation.

13. An automatic machine as recited in claim 12 for sealing said blank, wherein said means comprising said at least one adhesive applicator comprises:

at least one glue applicator placed at said acute angle relative to said path of motion of said blank along said guide means, wherein said at least one glue applicator is responsive to at least a first pressure during a first gluing activity and a second pressure during a second gluing activity to apply adhesive to said selected portions of said blank.

14. An automatic machine as recited in claim 13 wherein said acute angle is about 60 degrees and wherein said second pressure supplied to said at least one glue applicator is substantially greater than said first pressure so as to apply an approximately equal volume of adhesive per unit length during said first and second gluing activity.

15. An automatic machine as recited in claim 12 wherein:

said blank storage magazine includes means for adjusting to accommodate various widths of said blank;

said first folding means include means for adjusting to accommodate different lengths and widths of said blank;

said second folding means include means for adjusting to accommodate different widths and heights of said blank; and said compression chamber includes means for adjusting to accommodate different lengths and widths of said blank.

16. A method for erecting a sealed container from a blank comprising the following steps in the sequence set forth:

moving said blank in a first direction;

folding said blank to form a partially erected container as said blank moves in said first direction;

advancing said partially erected container in a second direction normal to said first direction;

folding said partially erected container into a semi-erected container as said partially erected container advances in said second direction;

applying glue to said blank on all surfaces requiring glue from at least one glue applicator during said step of advancing said partially erected container in said second direction;

transporting said semi-erected container in a third direction normal to said second direction and parallel to said first direction;

folding said semi-erected container to form a fully erected container as said semi-erected container is transported in said third direction; and compressing said said fully erected container to await curing of said glue whereby said container is sealed.

17. A method in accordance with claim 16 further comprising the following steps:

storing at least one said blank adjacent said first direction; and transferring at least one said blank to a starting position associated with said first direction.

18. A method as recited in claim 16 for erecting a sealed container from said blank having a first flap in a first plane and a second flap in a second plane, wherein the step of applying glue to said blank further comprises the steps of:

placing said at least one glue applicator adjacent said second direction;

aiming said at least one glue applicator at an acute angle relative to said second direction, and operating said at least one glue applicator to dispense glue over a portion of said first flap and over a portion of said second flap during said step of advancing said partially erected container along said second direction.

19. A method for erecting a sealed container from a blank having a side flap and a front panel requiring glue comprising the steps of:

moving said blank in a first direction;

folding said blank to form a partially erected container as said blank moves in said first direction;

advancing said partially erected container in a second direction normal to said first direction;

folding said partially erected container into a semi-erected container as said partially erected container advances in said second direction;

placing at least one glue applicator adjacent said second direction;

aiming said at least one glue applicator at an acute angle relative to said second direction;

operating said at least one glue applicator to dispense glue over a portion of said side flap and over a portion of said front panel of said partially erected container during said step of advancing said partially erected container along said second direction;

transporting said semi-erected container in a third direction normal to said second direction and parallel to said first direction;

folding said semi-erected container to form a fully erected container as said semi-erected container is transported in said third direction; and compressing said said fully erected container to await curing of said glue whereby said container is sealed.

20. A method as recited in claim 19 for erecting a sealed container wherein the step of operating said at least one glue applicator further comprises:

activating said at least one glue applicator to apply glue to said portion of said side flap as said partially erected container is advancing in said second direction;

deactivating said at least one glue applicator at a preselected position on said side flap;

reactivating said at least one said glue applicator to apply glue to said portion of said front panel from said at least one glue applicator as said partially erected container is advancing in said second direction; and deactivating said at least one glue applicator at a preselected position on said front panel.

21. A method as recited in claim 20 for erecting said sealed container further comprising the steps of:

supplying a first air pressure to said at least one glue applicator during said step of activating said at least one glue applicator so as to apply a first quantity of adhesive to said side flap having a first volume per unit length of said side flap; and providing a second air pressure to said at least one glue applicator during said step of reactivating said at least on glue applicator so as to apply a second quantity of adhesive to said front panel having a second volume per unit length of said front panel.

22. A method as recited in claim 21 for erecting said sealed container wherein said step of providing said second air pressure includes supplying said second pressure at a value at least as great as said first pressure.

23. A method as recited in claim 21 for erecting said sealed container wherein the step of providing said second pressure includes supplying said second pressure at a value substantially greater than said first pressure so that said second volume is approximately the same as said first volume.

* * * * *